US009222619B2

(12) United States Patent
Macaluso et al.

(10) Patent No.: US 9,222,619 B2
(45) Date of Patent: Dec. 29, 2015

(54) APPARATUS FOR UNLOADING CNG FROM STORAGE VESSELS

(71) Applicants: Virgil Macaluso, Independence, KS (US); Catalytic Industrial Group, Inc., Independence, KS (US)

(72) Inventors: Virgil Macaluso, Independence, KS (US); Corey Lowdon, Indepenence, KS (US)

( * ) Notice: Subject to any disclaimer, the term of this patent is extended or adjusted under 35 U.S.C. 154(b) by 0 days.

(21) Appl. No.: 14/700,996

(22) Filed: Apr. 30, 2015

(65) Prior Publication Data

US 2015/0233528 A1 Aug. 20, 2015

Related U.S. Application Data

(62) Division of application No. 14/335,555, filed on Jul. 18, 2014, now Pat. No. 9,046,218.

(60) Provisional application No. 61/856,348, filed on Jul. 19, 2013.

(51) Int. Cl.

| | |
|---|---|
| ***F17C 5/06*** | (2006.01) |
| ***F17C 7/00*** | (2006.01) |
| ***F17C 13/04*** | (2006.01) |

(52) U.S. Cl.

CPC ... *F17C 5/06* (2013.01); *F17C 7/00* (2013.01); *F17C 13/04* (2013.01); *F17C 2221/033* (2013.01); *F17C 2223/0123* (2013.01); *F17C 2223/035* (2013.01); *F17C 2225/0123* (2013.01); *F17C 2225/035* (2013.01); *F17C 2227/0304* (2013.01); *F17C 2260/021* (2013.01); *F17C 2260/032* (2013.01)

(58) Field of Classification Search

CPC ..... F17C 2221/033; F17C 2223/0123; F17C 5/06; F17C 2260/032; F17C 7/00; F17C 13/04; F17C 2227/0304; F17C 2227/039

USPC ..... 141/1, 4, 11, 82, 94, 197, 302, 37, 231, 141/104–105

See application file for complete search history.

(56) References Cited

U.S. PATENT DOCUMENTS

| | | | |
|---|---|---|---|
| 5,003,782 | A | 4/1991 | Kucerija |
| 5,542,459 | A | 8/1996 | Price et al. |
| 5,557,858 | A | 9/1996 | Macaluso et al. |
| 5,603,360 | A | 2/1997 | Teel |
| 5,685,154 | A | 11/1997 | Bronicki et al. |

(Continued)

OTHER PUBLICATIONS

International Search Report and Written Opinion dated Oct. 15, 2014, in the corresponding PCT/US2014/047283 application filed Jul. 18, 2014.

*Primary Examiner* — Timothy L Maust
*Assistant Examiner* — Timothy P Kelly
(74) *Attorney, Agent, or Firm* — Hovey Williams LLP; Gregory Skoch

(57) ABSTRACT

Methods and apparatus for offloading CNG from high-pressure storage vessels (22) are provided. The methods and apparatus are operable to warm the offloaded CNG either before or after a letdown in pressure to ensure that the delivered product is gaseous and that delivery of condensed products to downstream equipment is avoided. Particularly, a heating assembly (32) configured to warm a stream offloaded from a vessel (22) and flowing through a coil-shaped conduit (84) by infrared energy emitted by one or more heating elements (70) is provided upstream or downstream of a pressure reduction device (50).

10 Claims, 15 Drawing Sheets

(56) References Cited

U.S. PATENT DOCUMENTS

| | | | | |
|---|---|---|---|---|
| 6,003,244 | A | 12/1999 | Johanson et al. | |
| 6,953,045 | B2 | 10/2005 | Enerson | |
| 7,066,730 | B2 | 6/2006 | Macaluso | |
| 8,613,201 | B2 | 12/2013 | Bayliff et al. | |
| 8,833,088 | B2 | 9/2014 | Bayliff et al. | |
| 9,046,218 | B2 * | 6/2015 | Macaluso | F17C 5/06 1/1 |
| 2002/0152681 | A1 | 10/2002 | Oh et al. | |
| 2006/0105283 | A1 | 5/2006 | Macaluso | |
| 2012/0192580 | A1 | 8/2012 | Santos | |

* cited by examiner

APPARATUS FOR UNLOADING CNG FROM STORAGE VESSELS

RELATED APPLICATION

This application is a divisional of U.S. patent application Ser. No. 14/335,555, filed Jul. 18, 2014, which claims the priority benefit of U.S. Provisional Patent Application No. 61/856,348, filed Jul. 19, 2013, each of which is incorporated by reference herein.

BACKGROUND OF THE INVENTION

1. Field of the Invention

The present invention is generally directed toward apparatus and methods for offloading a high-pressure gas, such as compressed natural gas, from a storage vessel and reducing the pressure thereof to levels more suitable for use by vehicles, generators, heating equipment, and the like, while ensuring that the delivered product remains in gaseous form.

2. Discussion of the Prior Art

In the United States, natural gas has typically been transported in pipelines, and the pressures for local distribution are usually 50 psi or less. Regional networks supplying those systems are typically 720 psi or less with long distance transmission lines being typically 720 psi to 1480 psi. There are a few lines accommodating pressures of up to about 2150 psi. This grid supplies most of the U.S. where gas distribution networks exist. Areas in the northeast, which typically rely on fuel oil for heating, and rural and western areas that have a low density population that do not have enough usage to support the development of a supply network, rely on propane, electricity, wood or fuel oil to provide home heating and other energy needs for processing applications, irrigation and other energy uses.

As the relative price relationships of these energy sources has changed, due to new sources of energy being found, the economic opportunities created by these shifts in the status quo have created all sorts of new energy opportunities. Since natural gas is, in most cases, the lowest cost and usually most convenient energy form, there are lots of new conversion opportunities. Where pipelines are available, their use is preferable, but many newer opportunities, such as natural gas produced in remote petroleum extraction operations, cannot benefit because they are not served by existing natural gas distribution sources. These non-traditional sources have two natural gas alternatives: either compressed natural gas (CNG) or liquefied natural gas (LNG). Each has its own set of advantages and challenges.

LNG may be transported under low-pressure, but cryogenic conditions. Complex and capital-intensive cryogenic refrigeration systems are needed to liquefy and transport the natural gas in this fashion. With respect to CNG, economical storage and transportation requires that the gas be under high pressure, typically several thousand psi, but at or near ambient temperatures. However, most practical uses for CNG require the gas to be delivered at much lower pressures, typically less than 100 psi. Reducing the pressure of CNG from storage to use conditions can be very challenging, as a large pressure drop may result in significant reductions in gas temperature and even condensation of at least a portion of the gas, which may be incompatible with certain handling equipment. Moreover, because many opportunities for using the CNG recovered in remote locations lie within those same remote locations, permanent gas-handling facilities to adequately process the CNG to useable conditions are generally uneconomical.

SUMMARY OF THE INVENTION

The present invention addresses the foregoing challenges by providing methods and apparatus for unloading CNG from high-pressure storage vessels and delivering a reduced-pressure, gaseous hydrocarbon product suitable for immediate use as an energy source. According to one embodiment of the present invention there is provided an apparatus for unloading compressed natural gas (CNG) from a storage vessel. The apparatus comprises a conduit configured to conduct a natural gas stream through at least a portion of the apparatus. The conduit comprises an inlet and an outlet, the inlet having a lower elevation within the apparatus than the outlet. At least one infrared heater is positioned adjacent to at least a portion of the conduit and configured to deliver energy to the conduit for heating of the natural gas stream flowing therethrough. A pressure let down valve is located upstream or downstream from the conduit and operable to reduce the pressure of the natural gas stream. The apparatus further comprises coupling structure for connecting the apparatus to the storage vessel containing the CNG and delivering CNG offloaded from the storage vessel to the apparatus.

According to another embodiment of the present invention there is provided a system for generating a usable natural gas stream from a source of compressed natural gas (CNG) comprising one or more storage vessels containing CNG, and apparatus for unloading the CNG from the one or more storage vessels and operable to deliver a natural gas stream at a pressure lower than the pressure of the CNG within said one or more storage vessels. The apparatus comprises coupling structure for connecting the apparatus to the storage vessel containing the CNG and delivering CNG offloaded from the storage vessel to said apparatus. A conduit comprising an inlet and an outlet is configured to conduct the natural gas stream through at least a portion of the apparatus. At least one infrared heater is positioned adjacent to at least a portion of the conduit and configured to deliver energy to the conduit for heating of the natural gas stream flowing therethrough. A pressure let down valve is located downstream from the coupling structure and upstream or downstream from the conduit and operable to reduce the pressure of the natural gas stream.

According to still another embodiment of the present invention there is provided an apparatus for unloading compressed natural gas (CNG) from a storage vessel. The apparatus comprises a conduit configured to conduct a natural gas stream through at least a portion of the apparatus. The conduit comprises an inlet section and an outlet section, with the inlet and outlet sections being connected by an intermediate portion. The intermediate portion being configured as a helical coil. At least one infrared heater is positioned adjacent to at least a portion of the conduit and configured to deliver energy to the conduit for heating of the natural gas stream flowing therethrough. A pressure let down valve is located upstream or downstream from the conduit and operable to reduce the pressure of the natural gas stream. Coupling structure is also provided for connecting the apparatus to the storage vessel containing the CNG and delivering CNG offloaded from the storage vessel to the apparatus.

According to yet another embodiment of the present invention there is provided a method of unloading compressed natural gas (CNG) from one or more storage vessels. The method generally comprises providing a natural gas unloading apparatus comprising coupling structure for connecting the apparatus to the one or more storage vessels containing the CNG and delivering a natural gas stream offloaded from the storage vessel to the apparatus. A conduit comprising an inlet and an outlet is configured to conduct the natural gas stream through at least a portion of the apparatus. At least one infrared heater is positioned adjacent to at least a portion of the conduit and configured to deliver energy to the conduit for heating of the natural gas stream flowing therethrough. A pressure let down valve is located downstream from the coupling structure and upstream or downstream from the conduit and operable to reduce the pressure of said natural gas stream. One or more of the storage vessels containing the CNG are connected to the natural gas unloading apparatus via the coupling structure. The CNG is then caused to flow toward the apparatus as the natural gas stream. The natural gas stream is heated by passing the natural gas stream through the conduit either before or after the natural gas stream is passed through the let down valve and the pressure thereof is reduced. A useable natural gas product is then delivered from the natural gas unloading apparatus.

DETAILED DESCRIPTION OF THE INVENTION

Figure 1:
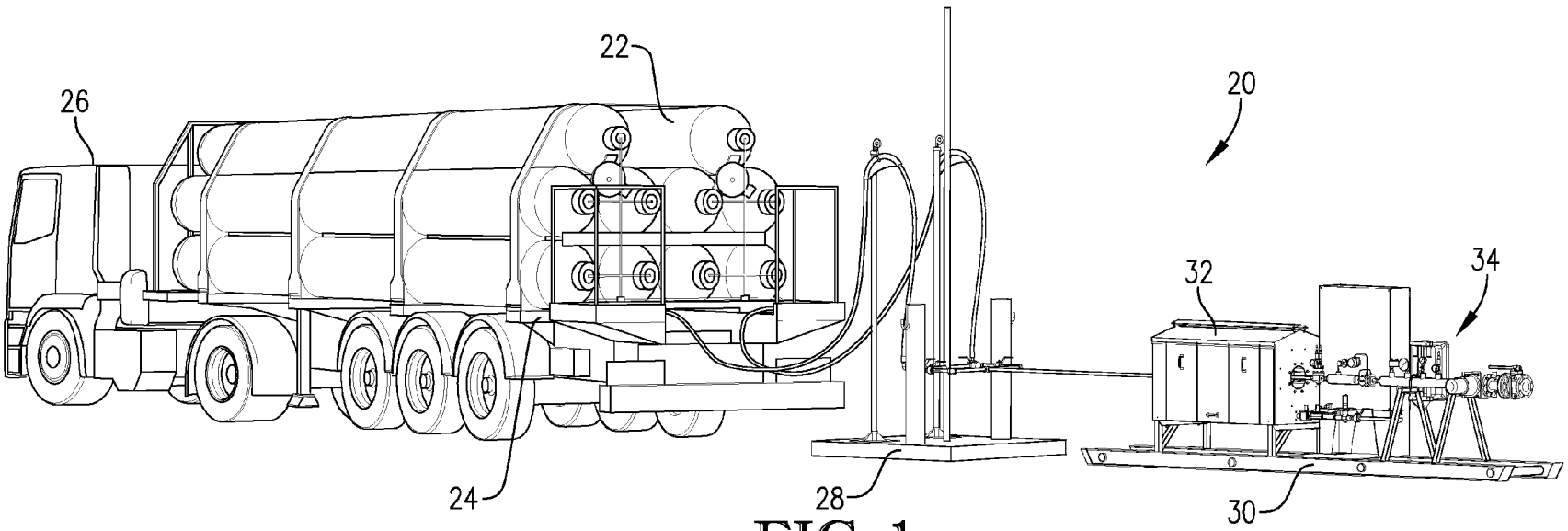
FIG. 1 is a schematic view of a CNG unloading system in accordance with one embodiment of the present invention.

A number of applications exist for uses not served by an established pipeline. These applications, which may or may not involve manned supervision, fall into several groups including:

1) Large industrial users that are converting form coal, fuel oil, bark or other energy sources. These users typically have a continuous delivery requirement with uninterrupted and unmanned flow requirements. They may have some supervision available in upset conditions.

2) Stationary small customers who could be grouped into a non-connected supply grid. For example, a town which would convert from fuel oil to natural gas but would be supplied by a distribution company responsible for the network and constant source of supply. These users would have a very high continuous delivery on line requirements with probably no or limited manned supervision. This supervision requirement might vary in larger capacity systems because of the expectation for the system to have no tolerance for being off line.

3) Mobile highway transportation—cars, trucks, etc.—with on-board supervision.

4) Mobile non-highway transportation applications—ships, trains, tugboats, etc.—with on-board supervision.

5) Stationary engine driven equipment—irrigation, power generation, compressors, turbines, etc. These typically would have no or limited manned supervision.

6) Portable/mobile engine driven industrial equipment—drilling rigs, frac trucks, grinding, mining or pumping equipment, of substantial size. Typically there would be people in the area, who are available, or, alternatively, have full time supervision responsibilities for the fuel monitoring process.

7) Supply of temporary gas service to customers stranded by utility service interruptions due to work on the distribution system, which can be considered a sub-set of item 2. Typically there would be continuous on-site manned supervision of the process.

8) Recovery of stranded gas. Unloading process, when done alone, would typically be unmanned, but would typically occur at a high rate with frequent return trips.

All of these applications have some CNG letdown component potential. Items related to category 1 and most in category 2 will require a full time source of CNG to meet all of the demand, all of the time. Items in groups 3 and 4 will typically have on-board capabilities to heat, or the process will proceed at a slow enough rate so as to not require capabilities that require outside heat sources to overcome the refrigeration effect related to pressure letdown. The applications in categories 5 and 6 may have alternate sources of fuel (bi-fuel), which may supplement or replace other fuels when they are available, or when conditions are right for the alternate CNG source of fuel to offset the more expensive primary power fuel. A diesel/CNG bi-fuel engine conversion would be such an example. Continuous supply of fuel, at whatever the demand, is not usually a requirement for these applications. Item 7 is becoming quite common and can vary considerably in size. This process is almost always supervised continuously by well-qualified gas service personnel. Item 8 would capture gas, which would typically be vented or flared. The requirement here, when not used as a fuel source for one of the other items, is a little unique in that the unloading rate would typically be at a constant heat input rate instead of a constant gas flow volume. In this case, the flow would start out slow and increase by many times the initial rate as the unload process nears the end of the cycle.

Each of the categories reviewed above have some unique requirements, but most revolve around tying the heat requirement to a fixed or demand driven variable process fuel flow rate. One of the more significant issues involves having enough span on the regulators without limiting the flow on the low pressure condition, while providing adequate and appropriate over-pressure protection all of the way through the system. If the over-pressure protection equipment has to vent to appropriately work, it could also cause hazards associated with a large vent rate because of the high pressures involved.

The present invention provides different CNG letdown apparatus to accommodate any number of applications falling within, for example, categories 1, 2, 5, 6, 7 and 8 above. In applications which process smaller quantities of CNG, one particular approach is to supply heat to the high-pressure CNG stream followed by pressure let down. In applications that process much larger quantities of gas or high gas flow rates, condensation of the gas to a liquid becomes a concern due to the cooling and pressure changes associated with the pressure letdown. In these larger-volume applications, pressure reduction may occur first followed by application of heat. Any condensed liquids generated during pressure let down can be re-vaporized within the apparatus, prior to discharge therefrom.

Natural gas, while predominantly methane, can include varying amounts of $C_2$+ components. The most common hydrocarbon components besides methane that may be present in natural gas are ethane, propane, and butane. These other components liquefy at higher temperatures than methane. However, in many applications that are amenable to use natural gas as a fuel source, it is undesirable to attempt to use a mixed phase fuel source. Therefore, embodiments of the present invention are operable to ensure re-vaporization of any condensable hydrocarbons prior to being delivered for use as a fuel source.

Turning now to FIG. 1, a CNG offloading system 20 is shown offloading CNG from pressurized tanks 22 secured on a trailer 24 coupled with a semi-tractor 26. System 20 includes a coupling assembly 28 and a letdown skid 30, which includes a heater assembly 32 and an instrumentation and connector manifold 34. As can be seen from FIG. 1, semi-tractor 26 and trailer 24 can be positioned adjacent to coupling assembly 28, at which point the tractor and trailer can be uncoupled if desired. Trailer 24 comprises a plurality of tanks 22, which as explained in greater detail below, is useful in applications requiring a continuous supply of CNG. Skid 30 is configured to be readily offloaded from a transport vehicle onto nearly any type of surface, whether it is a concrete pad or raw earth. However, it is within the scope of the present invention for the offloading system 20 to be mounted, for example, on a portable trailer to facilitate transport to and from desired locations. See, FIG. 14. Such trailer-mounted systems can be "self-contained" and include a generator capable of generating electrical power for operation of the offloading system, a standby uninterrupted power supply (UPS) and/or cellular or satellite communication capabilities to alert a remote operator of any change in operational parameters or the need to replace trailer 24. For installations within extreme environments, system 20 can be enclosed in an insulated container, such as a shipping container.

Figure 2:
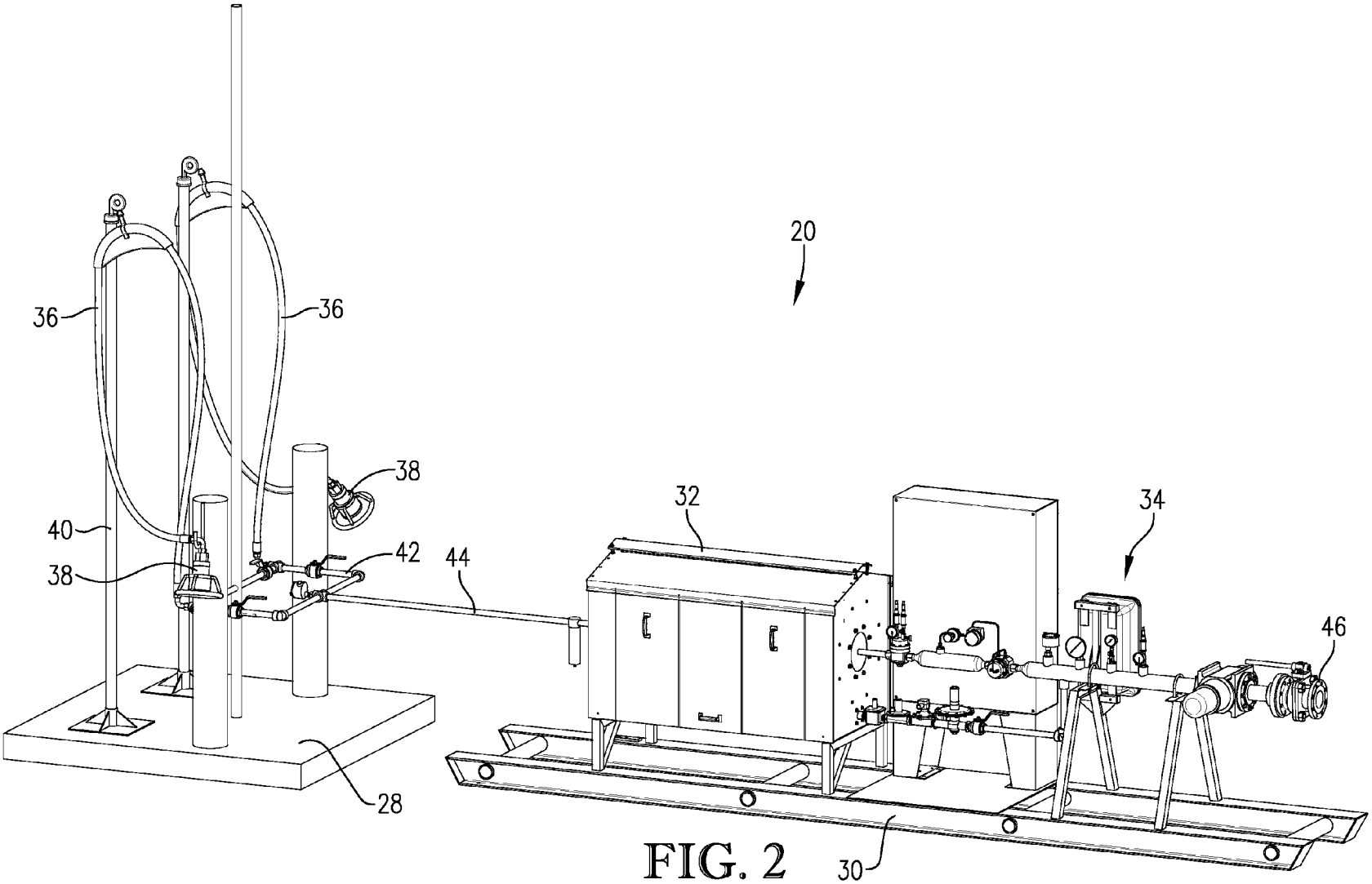
FIG. 2 is a CNG let down apparatus in accordance with one embodiment of the present invention.

As best shown in FIG. 2, coupling assembly 28 comprises a pair of hoses 36 each of which is equipped with a coupler 38 configured for attachment to corresponding structure on tanks 22. Hoses 36 are preferably CNG-rated flexible hoses and are depicted as tethered to posts 40. Hoses 36 are fluidly coupled with an inlet manifold 42 that is configured to permit selective flow of CNG from either or both of hoses 36 toward skid 30 via conduit 44. CNG offloaded from tanks 22 then passes through heating assembly 32 and manifold 34, which is equipped with connector structure 46 permitting the letdown gas to be distributed and used as desired.

Figure 3:
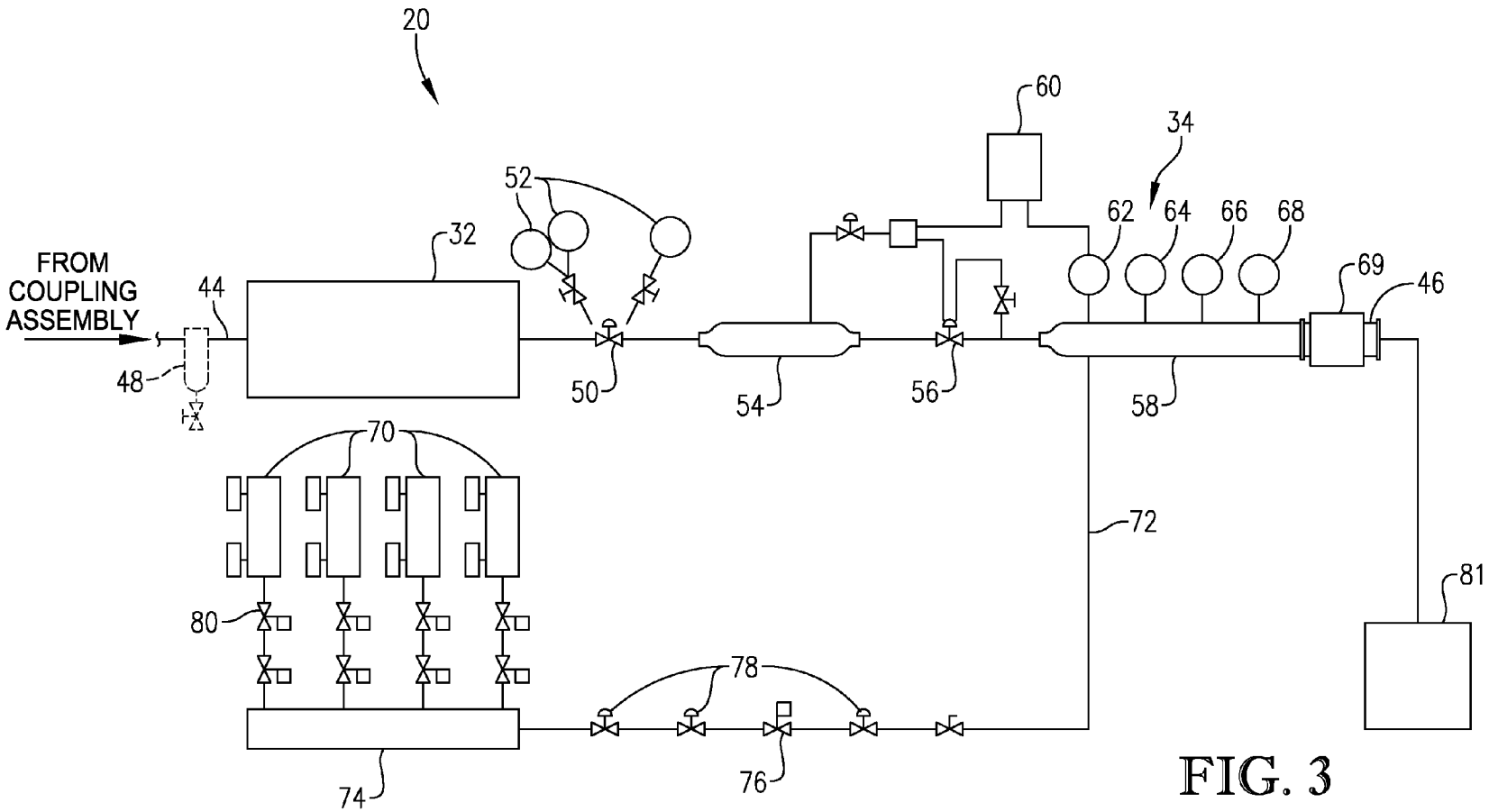
FIG. 3 is a piping and instrumentation diagram of a CNG unloading system according to one embodiment of the present invention.

The set up of system 20 is schematically depicted in FIG. 3. After being off-loaded from tanks 22 via coupling assembly 28, the CNG is delivered to heating assembly 32 via conduit 44 and optionally passing through a filter 48, which collects and removes possible contaminants, such as water, compressor oil, and suspended particulates. The CNG is warmed within heating assembly 32. The structure and operation of heating assembly 32 is explained in greater detail below. Following heating assembly 32, the warmed CNG undergoes pressure reduction by passage through one or more pressure-reducing or letdown valves. In certain embodiments, the pressurized CNG tanks 22 may have an initial pressure of more than 1000 psig, more than 2000 psig, or more than 3000 psig. In particular embodiments, tanks 22, when full, may have a pressure of between about 2000 to about 4500 psig, between about 3000 to about 4000 psig, between about 3400 to about 3800 psig, or about 3600 psig. In order to achieve the desired pressure reduction, the pressure may be reduced by passage through one or more Joule-Thompson (J-T) valves. The warmed CNG is initially passed through valve 50, whose operation can be monitored using various pressure-sensing devices 52, such as pressure gauges and pressure transducers. Following passage though valve 50, the partially letdown gas passes through vessel 54, which comprises part of instrumentation and connector manifold 34.

Next, the partially let down gas passes through another J-T valve 56 where its pressure is decreased to the desired, final delivery pressure. In certain embodiments, the final delivery pressure may be less than 500 psig, less than 300 psig, or less than 150 psig. In particular embodiments, the reduced-pressure gas exiting valve 56 has a pressure between about 50 to about 400 psig, between about 75 to about 250 psig, or between about 80 to about 150 psig. The reduced-pressure gas from valve 56 then enters another small vessel 58, which also comprises part of instrumentation and connector manifold 34. In certain embodiments, vessels 54 and 58 function as mounting points for various nozzles, instrumentation and gauges required for operation of system 20. Operably coupled with manifold 34 are a plurality of temperature and pressure sensors for measuring the characteristics of the gas undergoing pressure reduction and providing information to a central panel 60 that provides automated control over the operation of system 20. For example, a temperature transmitter 62 operable to provide real-time temperature data to panel 60 may be mounted upon vessel 58, as are a temperature indicator gauge 64, a pressure indicator gauge 66, and a pressure transducer 68. Vessel 58 may also be equipped with an optional flow meter 69 for measuring the flow rate of the reduced pressure gas being produced by system 20. As explained in greater detail below, the data provided by these instruments permits the panel 60 to make real-time, automated adjustments to various portions of operation of system 20 so that the pressure of the CNG can be let down to a desired level while avoiding delivery of any condensed products into vessel 58.

Heat is provided to warm the CNG stream flowing through heating assembly 32 by one or more flameless infrared heating elements 70 located within assembly 32. In certain embodiments, elements 70 are natural-gas fueled, flameless catalytic heaters. Thus, elements 70 are configured to operate using the reduced-pressure natural gas provided by system 20. Exemplary flameless, infrared heating elements include those available from Catalytic Industrial Group, Independence, Kans., and described in U.S. Pat. Nos. 5,557,858 and 6,003,244, both of which are incorporated by reference herein. It is also within the scope of the present invention to use electrically-powered, infrared heating elements. The power source for such electrical heating elements may be a generator that utilizes the reduced-pressure natural gas from system 20 as a fuel source. As depicted in FIG. 3, reduced-pressure gas may be delivered from vessel 58 via conduit 72 toward heating element manifold 74. The flow of gas from vessel 58 to manifold 74 may be controlled by a valve 76 with additional pressure reduction or regulation, if necessary, being provided by valves or pressure regulators 78. The flow of gas to individual heating elements 70 may be automatically controlled by panel 60 through selective operation of valves 80. Therefore, based upon data received from the various sensors 62, 64, 66, and 68, control panel 60 can adjust the heat output of heating elements 70 through operation of valves 80. For example, if temperature transmitter 62 is transmitting a temperature for the reduced pressure gas exiting letdown valve 56 that is below a predetermined threshold valve, panel 60 can open valves 80 to provide more fuel to heating elements 70 so that more heat can be delivered to the CNG stream flowing through heating assembly 32.

Gas product delivered from vessel 58 through connector structure 46 can be directed to a device 81, such as a fueling station for a vehicle having an internal combustion engine configured to operate on natural gas, a generator configured to operate on natural gas, or pipeline structure configured to deliver natural gas to buildings for heating purposes.

Figure 4:
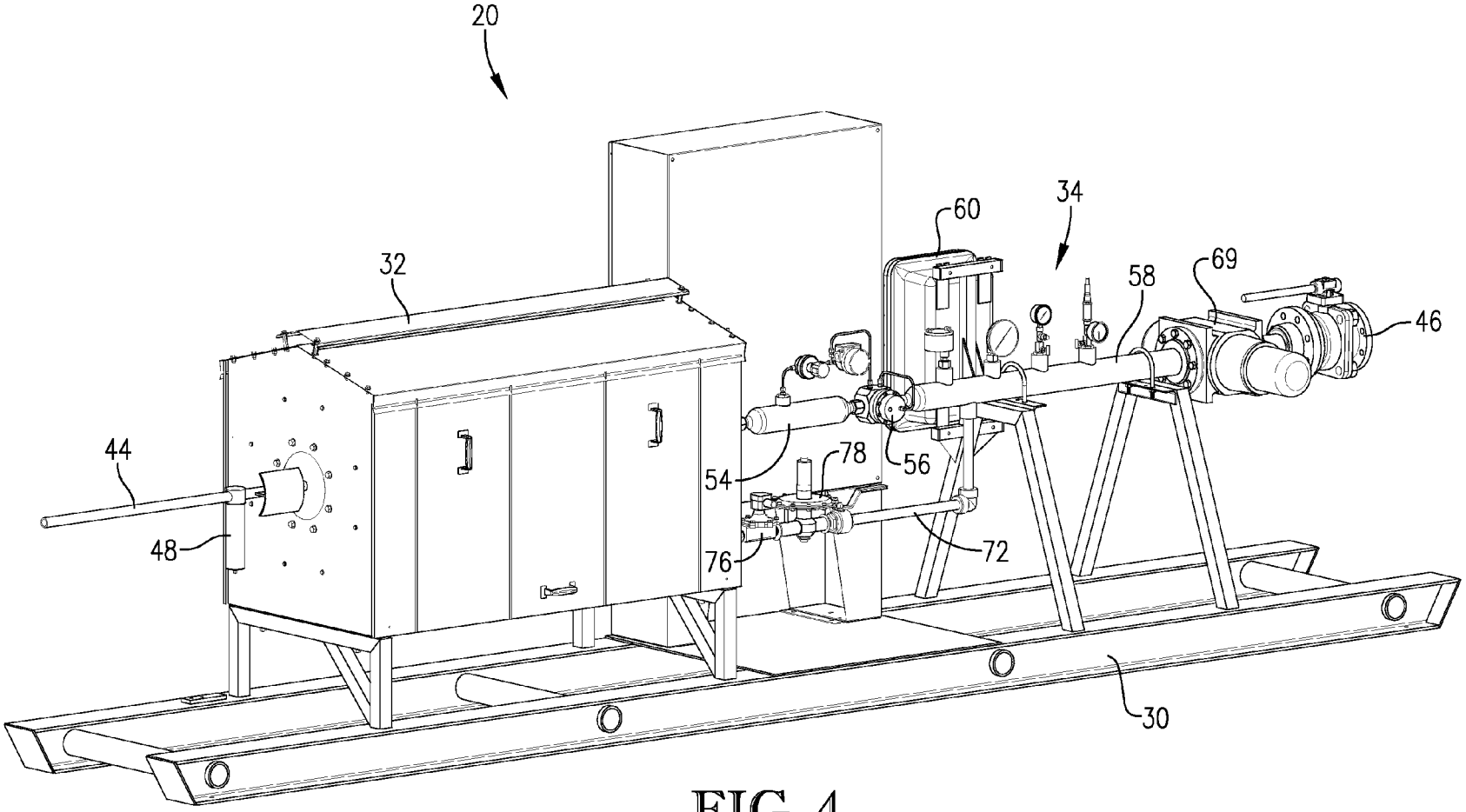
FIG. 4 is a close up view of a CNG let down apparatus depicted in FIG. 2.
Figure 5:
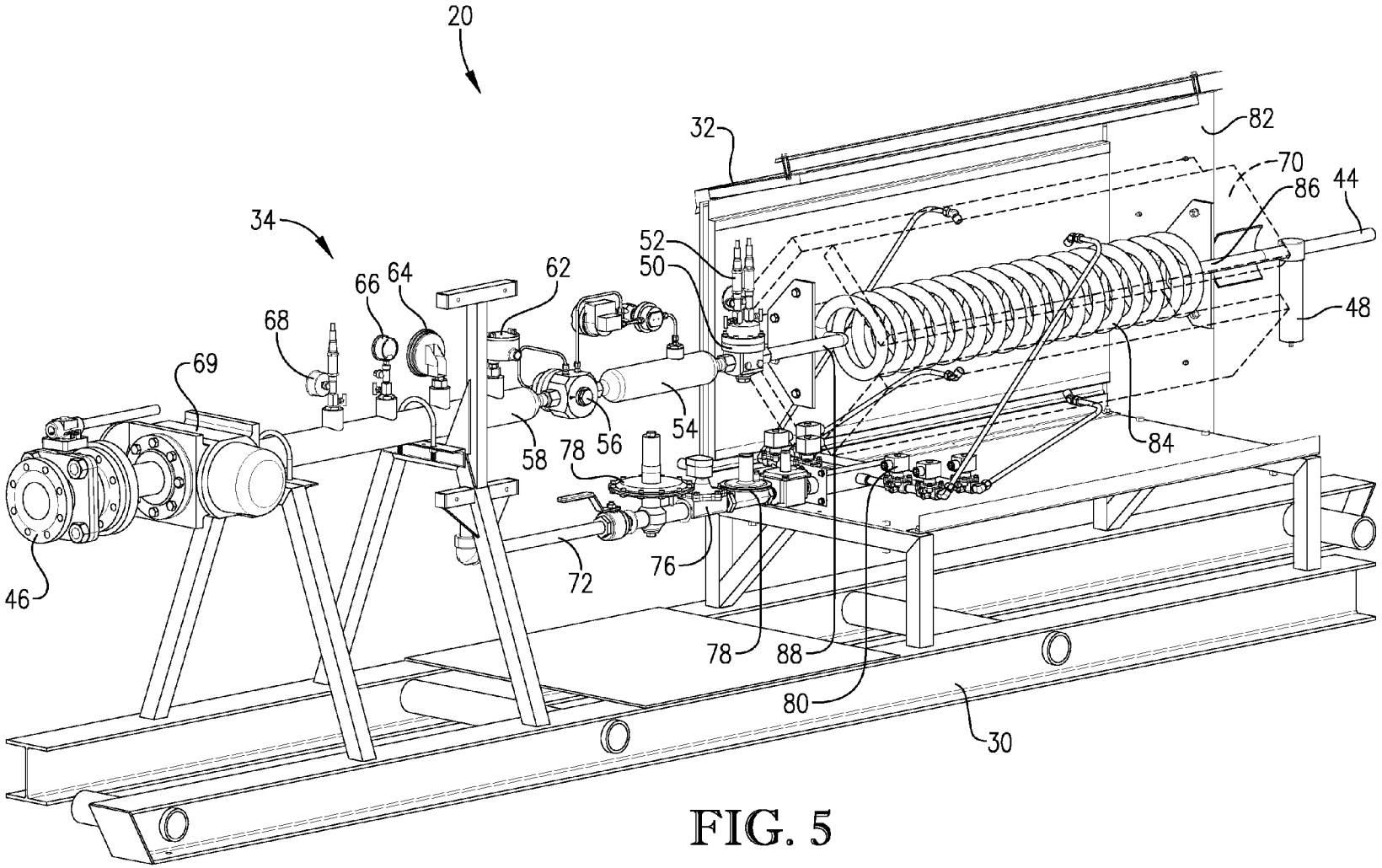
FIG. 5 is a partial cross-sectional view of the CNG letdown apparatus depicted in FIG. 4.

Turning now to FIGS. 4 and 5, an exemplary embodiment of system 20, which was schematically depicted in FIG. 3, is illustrated. With particular reference to FIG. 5, the internal features of heating assembly 32 are shown. The CNG offloaded from tanks 22 is directed toward assembly 32 via conduit 44. Assembly 32 comprises a vented housing 82 inside of which are disposed four heating elements 70 arranged in a diamond array. A coil-shaped conduit 84 passes through the middle of the array of heating elements 70. As illustrated, conduit 84 is arranged as a horizontal "corkscrew" or right circular cylindrical coil and presents an inlet 86 and an outlet 88, although it is within the scope of the present invention for other coil configurations to be employed. In certain embodiments, inlet 86 and outlet 88 are coaxial along a substantially horizontal longitudinal axis that extends substantially through the middle of the coil. The coil presents at least one, and preferably multiple complete turns between inlet 86 and outlet 88. As the pressure letdown occurs downstream from heating assembly 32, the handling of condensed gases within conduit 84 is not a primary concern. Although, it is within the scope of the present invention for this coil configuration to be used in systems that letdown the pressure upstream of heating assembly 32. In such systems, each wrap of the coil provides a section of conduit 84 (i.e., the lowermost portion) where condensed fluids may collect and be re-vaporized prior to being discharged from heating assembly 32.

With respect to the system configuration illustrated in FIGS. 4 and 5, pressure letdown occurs post-heating. Thus, it is an important aspect of this embodiment to sufficiently warm the CNG stream passing through conduit 84 so that upon the reduction in pressure by valves 50 and 56, the heat loss associated with the Joule-Thompson effect does not result in the condensation of the natural gas components. The control systems put in place, namely the real-time adjustment of heating elements 70 output based upon the measured characteristics of the reduced pressure natural gas product downstream of valve 56, ensures that the natural gas product delivered from connector structure 46 is substantially, and preferably entirely, in the gaseous state. One or more of the temperature sensors 62 and 64 located downstream from valves 50 and 56 are operable to output a signal corresponding to the temperature of the reduced-pressure natural gas stream. The signal generated by one or more of these sensors is utilized by the control panel 60 to control the output of heating elements 70.

System 20, as depicted in FIGS. 1-5, is operable to provide a continuous output of reduced-pressure natural gas through connector structure 46. Thus, system 20 is configured to offload CNG from at least two tanks 22 simultaneously. In one mode of operation, CNG is primarily offloaded from a first tank under relatively high pressure. As CNG is offloaded, the pressure of the CNG remaining within the tank gradually decreases as does the pressure of the CNG passing through heating assembly 32. This translates into a reduced pressure drop across letdown valve 50 and less cooling of the reduced-pressure gas stream. The temperature sensors attached to vessel 58 detect this change in outlet temperature and the output of heating elements 70 can be reduced accordingly by restricting the flow of fuel to the elements, or selectively deactivating one or more elements. Once the pressure within tank 22 drops to a predetermined level, as may be detected by pressure sensors 52, control panel 60 can initiate the offloading of CNG from a second tank 22. This transition is preferably performed instantaneously, that is, flow from the first tank is shut off as the flow from the second tank commences. As the second tank is under higher pressure than the depleted first tank, the pressure of CNG flowing through heating assembly 32 rises. Accordingly, the pressure drop expected across valve 50 will increase along with the amount of cooling generated thereby and the temperature of the reduced-pressure natural gas within vessel 58 will drop. Control panel 60 can then increase the amount of fuel directed to heating elements 70, which results in the transfer of greater heat to the CNG flowing through coil 84, and thereby ensures that condensation of gas due to the pressure letdown across valves 50 and 56 is avoided.

Figure 6:
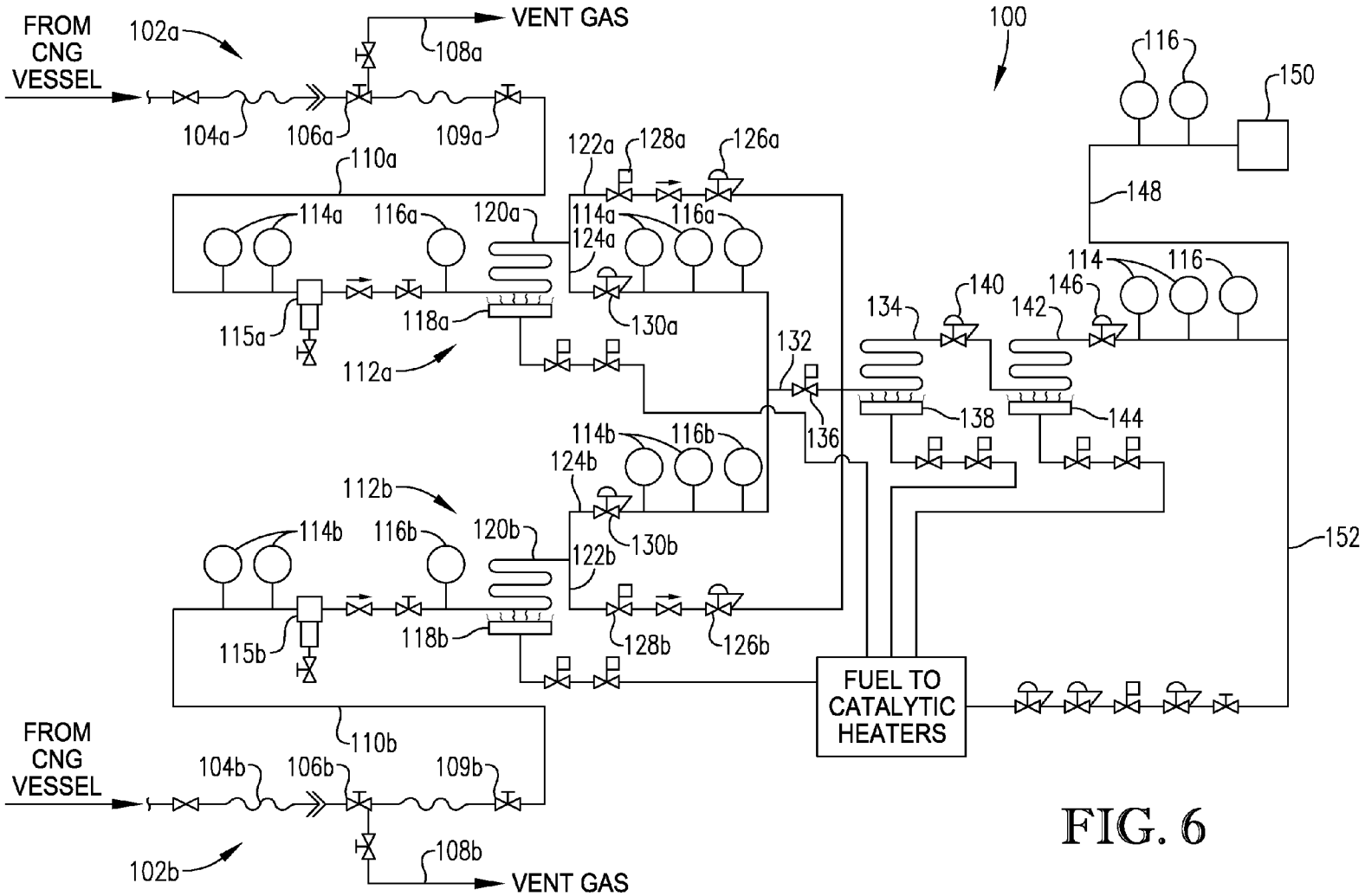
FIG. 6 is a piping and instrumentation diagram of a CNG unloading system according to another embodiment of the present invention.

FIGS. 6-9 illustrate another CNG offloading system 100 that is configured to permit continuous supply of reduced-pressure natural gas while minimizing the amount of residual gas remaining in the storage vessels (e.g., tanks 22). Stated differently, this embodiment of the present invention is operable to minimize the tare pressure on each unloaded storage vessel while permitting continuous supply of the reduced-pressure natural gas. System 100 is schematically depicted in FIG. 6. As with system 20, system 100 includes two offloading stations 102*a* and 102*b* each configured to be coupled with a vessel containing CNG at relatively high pressure. Offloading stations 102 generally comprise a conduit 104, which may comprise flexible CNG-rated hoses, a shutoff valve 106 and a vent hose 108 for bleeding or venting CNG to a safe location if conditions warrant. Note, further references to the respective "a" and "b" designations may be omitted herein for conciseness. It is understood that offloading stations 102*a* and 102*b* and their associated apparatus are similarly configured, and the general reference numeral refers to the structure appearing in each station.

A conduit 110 interconnects offloading stations 102 with respective pre-warming assemblies 112. Pre-warming assemblies 112 include pressure sensors 114 (e.g., pressure indicators and pressure transducers) and a temperature transmitter that can be operably connected with a control panel (158 of FIG. 7). As explained in greater detail below, these pressure and temperature sensors provide data that permits automated operation of system 100. Pre-warming assemblies 112 comprise one or more heating elements 118, similar to those described above, configured to supply heat to CNG flowing through conduit 120.

Depending upon the pressure within the vessel supplying the CNG, various downstream valves are opened or closed. This operation is explained in greater detail below. The gas then is directed into either conduit 122 or 124. Conduit 122 includes a letdown valve 126, such as a J-T valve, and a shutoff valve. Conduit 124 also includes a letdown valve 130. It is noted that in certain embodiments, valve 126 has a higher pressure set point than valve 130. Thus, conduit 122 is generally configured to handle higher pressure CNG flows, and conduit 124 is generally configured to handle lower-pressure CNG flows as the storage vessel becomes depleted. Conduit 124 further includes another set of pressure and temperature sensors 114, 116. Conduits 124*a* and 124*b* merge into conduit 132, and conduits 122*a* and 122*b* merge with conduit 132 into conduit 134 downstream of shut off valve 136. The reduced-pressure CNG in conduit 134 is warmed by one or more heating elements 138 prior to being passed through letdown valve 140, where its pressure is further reduced. The gas is then directed through conduit 142 where it is further warmed by one or more heating elements 144. The pressure of the gas is further reduced by passage through a final letdown valve 146. The gas product is delivered through conduit 148, which is equipped with various pressure and temperature sensors 114, 116, and a flow meter 150. A portion of the gas product may be diverted through conduit 150 to supply a fuel source for heating elements 118*a*, 118*b*, 138, and 144.

In order to ensure continuous delivery of reduced-pressure gas via conduit 148, offloading stations 102*a* and 102*b* are each operably connected with CNG storage vessels. It is within the scope of the present invention for additional offloading stations to be employed in order to process greater quantities of CNG. Assuming that the CNG storage vessels are substantially full of CNG, only one of stations 102*a* and 102*b* is operated initially. For example, high-pressure CNG is initially flowed through conduit 104*a*, while conduit 104*b* is closed off CNG continues flowing through conduit 110*a* toward pre-warming assembly 112*a* where the CNG is heated by infrared heating element 118*a* supplied with fuel from conduit 152.

As the pressure of the CNG flowing through conduit 120*a* is relatively high, the CNG is directed through conduit 112*a* and its pressure is reduced by passage through valve 126*a*. Passage of the CNG through valve 126*a* also results in a decrease in the temperature thereof. The reduced-pressure gas stream is then directed into conduit 134 where infrared heating element 138 warms the reduced-pressure gas stream. The pressure of this stream is further reduced by passage through valve 140. The letdown stream is warmed again by infrared energy emitted by heating element 144 while it is passed through conduit 142. The pressure of the stream is again reduced via valve 146 to its final desired pressure. It is noted that the amount of energy transferred to the stream by heating element 144 should be sufficient to avoid condensation of the gas stream following passage through valve 146 so that only gaseous product is delivered in conduit 148.

As the pressure of the CNG in the storage vessel operably connected to offloading station 102*a* decreases, so does the mass flow rate of CNG into system 100. At some point, the flow rate of CNG from offloading station 102*a* may become unacceptably low to support the demands for letdown gas from conduit 148 (e.g., for operation of a generator or vehicle filling station). However, the storage vessel may still contain a significant quantity of gas. System 100 is configured to permit each storage vessel to be drawn down to very low levels (e.g., 100 to 200 psig) while ensuring a continuous delivery of letdown gas in conduit 148. Therefore, upon decrease of the pressure of the gas flowing through conduit 104*a* to a predetermined level as determined by pressure sensors 114*a*, valve 128*a* may be closed thereby directing the flow of warmed CNG into conduit 124*a* and through letdown valve 130*a*. At the same time, CNG from the storage vessel operably coupled to offloading station 102*b* may be flowed into conduit 104*b*. The high-pressure CNG is then warmed in pre-warming assembly 112*b* and then directed into conduit 124*b*, by closure of valve 128*b*, and through letdown valve 130*b* where its pressure is reduced to the same level as the gas from valve 130*a*. Note, that the output of heating elements 118*a* and 118*b* may be independently controlled depending upon the heating requirements for each stream flowing through conduits 120*a* and 120*b*, respectively. As the pressure of the gas in conduit 124*b* will be reduced by a greater magnitude then the gas in conduit 124*a*, more heat may need to be emitted by heating element 118*b* so as to minimize or avoid condensation. However, should a portion of the reduced-pressure gas delivered by valve 130*b* be condensed, the downstream heating processes can be operated so as to re-vaporize any condensed product. As the pressure of the gas within conduit 124*a* decreases, the amount of heat supplied by heating element 118*a* may also be reduced due to the decreased Joule-Thompson effect when the gas is letdown across valve 130*a*. The streams from conduits 124*a* and 124*b* are combined in conduit 132, and the letdown process continues as described above.

In order to facilitate preferential flow of gas from the lower pressure storage vessel while drawing from two vessels simultaneously so as to empty the lower pressure vessel as completely as possible, the pressure set point for valve 130*a* may be set slightly higher than the set point for valve 130*b*. In certain embodiments, the difference in pressure set points between these valves is between about 1 psi to about 10 psi, between about 2 psi to about 8 psi, or between about 4 to about 6 psi. Thus, the flow across valve 130*a* is favored over the flow from the higher pressure vessel thereby permitting the lower pressure vessel to be drawn down to as low a level as possible while still ensuring adequate delivery of reduced pressure natural gas.

Once the pressure within the storage vessel operably coupled with offloading station 102*a* falls below a final, predetermined threshold (e.g., 200 psig), the flow of gas into conduit 104*a* can be stopped. At the same time, the gas flowing through the storage vessel operably coupled with offloading station 102*b* remains under relatively high pressure, and no longer needs to be reduced by such a large magnitude in a single letdown step. Thus, the flow of CNG through valve 130*b* can be stopped and the flow can be directed into conduit 122*b* by opening valve 128*b*. The CNG within conduit 122*b* can be letdown by passage through valve 126*b*. The reduced-pressure gas is then directed into conduit 134 and the letdown process continues as described above. At this time, offloading station 102*a* can be operably connected with a new CNG storage vessel, whose offloading may commence after the CNG storage vessel operably connected with offloading station 102*b* is drawn down to a predetermined level and flow may be switched back over to conduit 124*b*. Then, flow of CNG may resume through conduit 104*a* and through valve 130*a* while the pressure within the storage vessel operably connected with station 102*b* is drawn down to the final, predetermined level. Once that occurs, the flow of high-pressure CNG may be directed into conduit 122*a* and the process continues as described above.

The transition period where CNG is being offloaded from two storage vessels simultaneously also allows the portion of the system handling the full storage vessel to ease into the much higher heat requirements resulting from the greater Joule-Thompson effect, due to the higher overall pressure cut. This results in a reduced maximum heat requirement or a larger throughput capacity.

Figure 7:
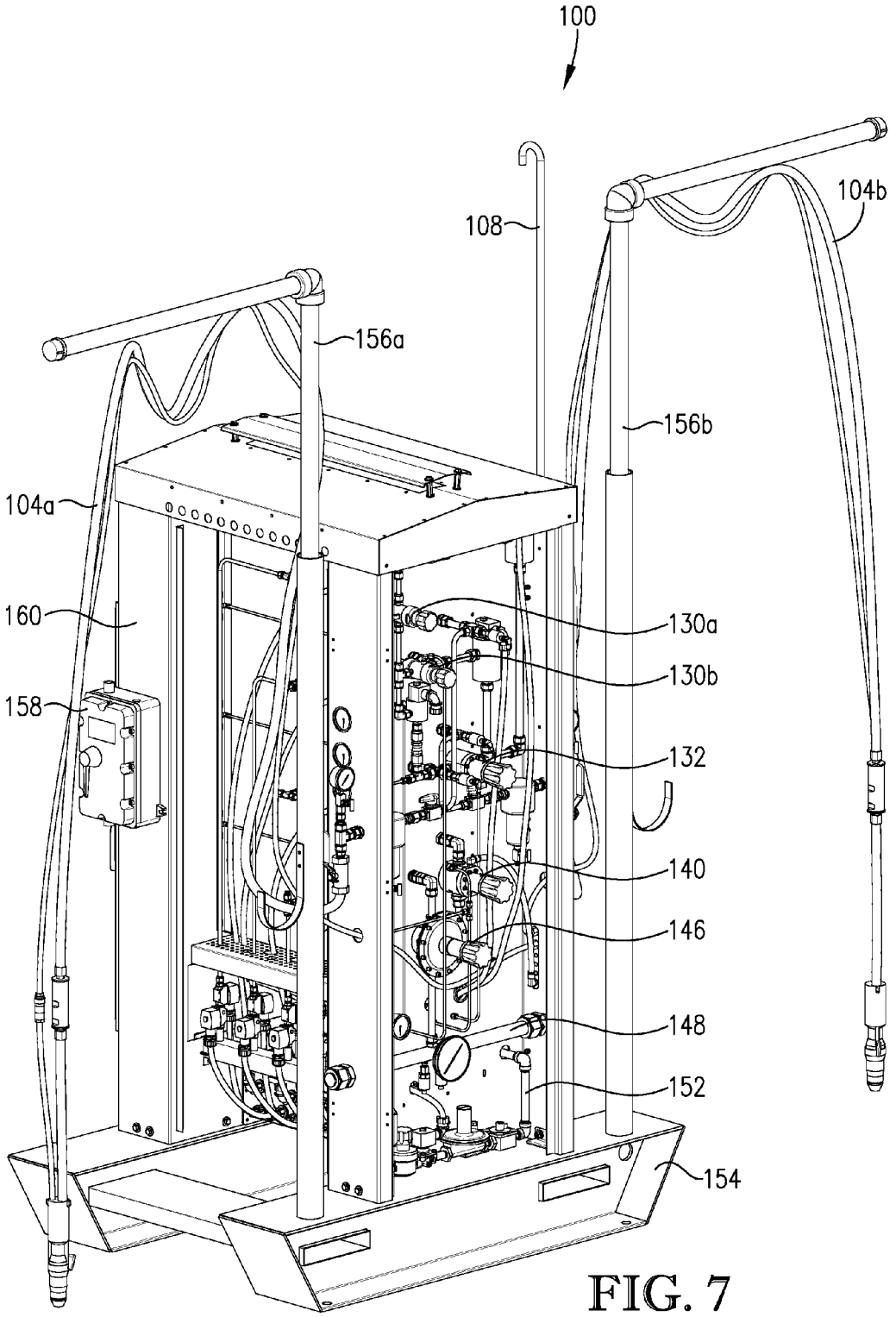
FIG. 7 depicts a CNG unloading system according to another embodiment of the present invention.
Figure 8:
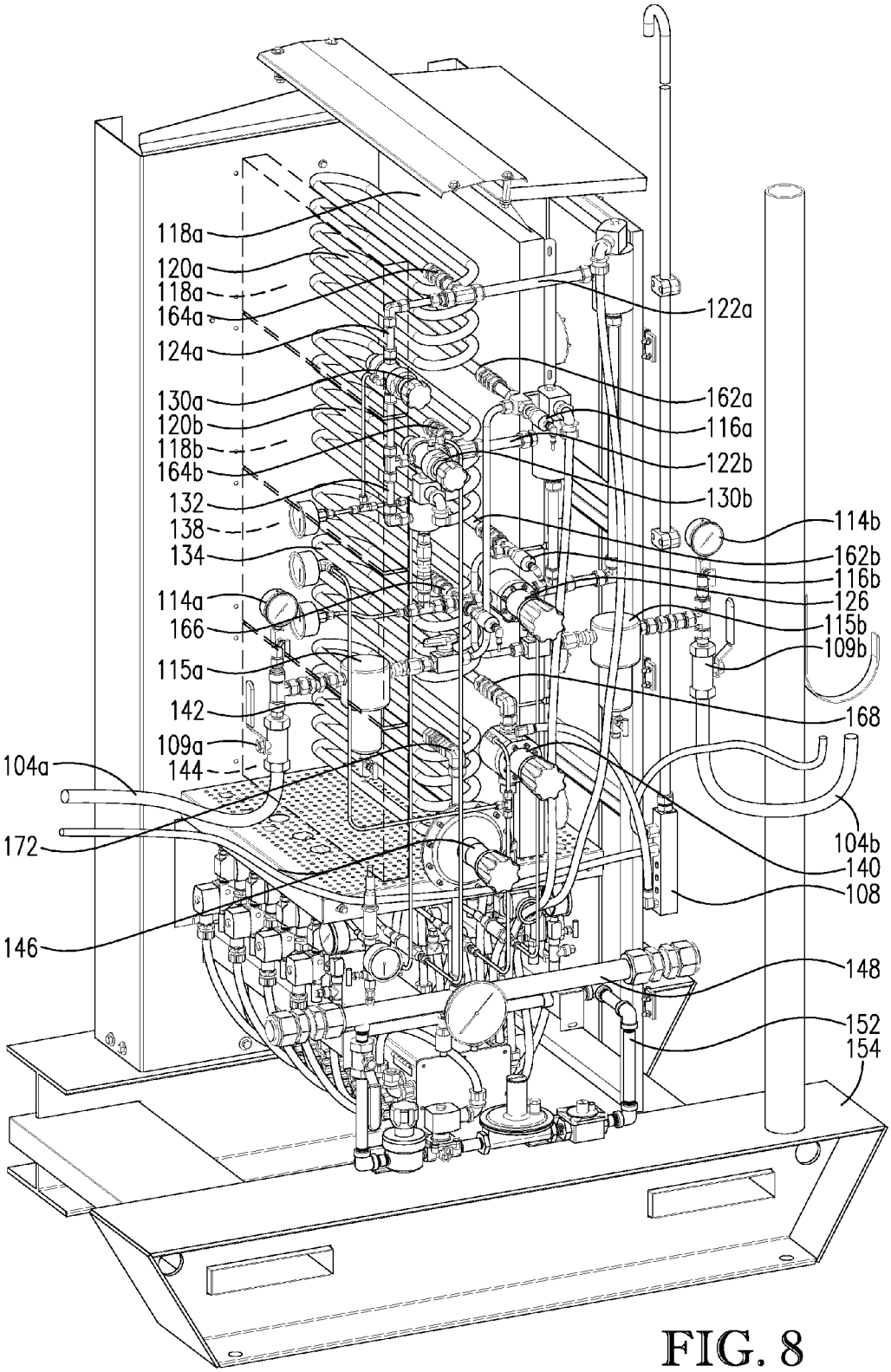
FIG. 8 is a partial cross-sectional view of the CNG unloading system of FIG. 7.
Figure 9:
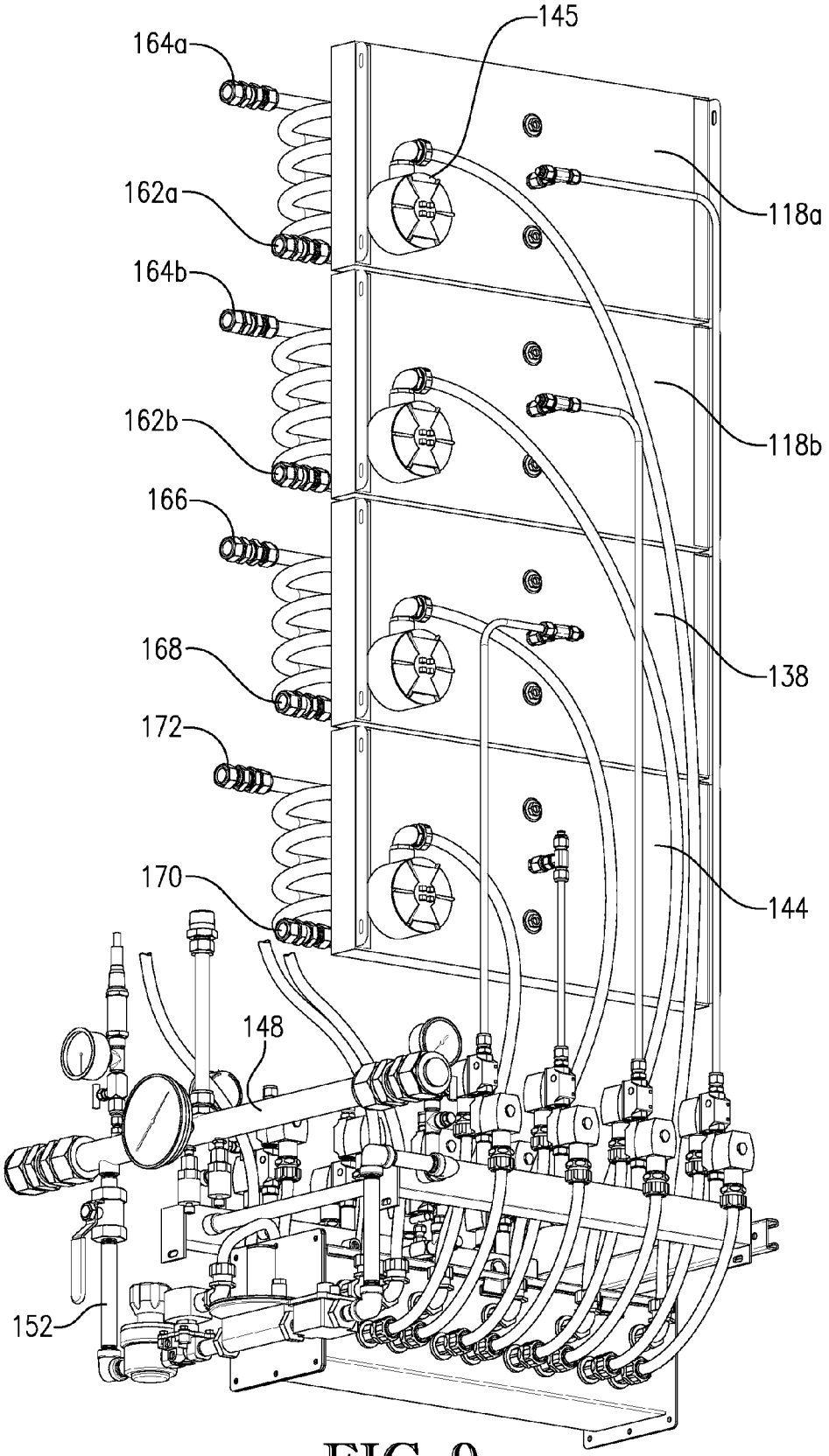
FIG. 9 is a further view illustrating certain internal components of the CNG unloading system of FIG. 7.

FIGS. 7-9 depict an exemplary offloading system 100 constructed in accordance with the scheme set forth in FIG. 6. The system 100 comprises a skid 154, which supports the majority of the apparatus utilized by the system. Conduits

104*a* and 104*b* are supported by hose support members 156*a* and 156*b*, respectively. A control box 158 may be mounted to an upright housing member 160 and used to house various electronic components necessary for automated operation of system 100. CNG is supplied through conduit 104*a* and passes through a manual shutoff valve 109*a* and a filter 115*a* en route to conduit 120*a*. A single venting unit 08 may also be provided that can be connected to various pressure relief or safety devices located through system 100. Conduit 120*a* is configured as a rounded rectangular cylindrical coil having a substantially vertical axis extending therethrough, although other coil shapes and configurations may be employed. The CNG generally flows upwardly through the coil, entering at a coil inlet 162*a* and exiting at a coil outlet 164*a*. The contents within conduit 120*a* are heated by a pair of laterally disposed heating elements 118*a*, such as those previously described.

CNG may be selectively flowed through conduit 104*b*, as described above, through shutoff valve 109*b* and filter 115*b* en route to conduit 120*b*. Conduit 120*b* is also configured as a rounded rectangular cylindrical coil, although other coil shapes and configurations may be employed. The CNG generally flows upwardly through the coil, entering at a coil inlet 162*b* and exiting at a coil outlet 164*b*. The contents within conduit 120*b* are heated by a pair of laterally disposed heating elements 118*b*.

The route taken by the CNG after passage through conduits 120*a* and/or 120*b*, as the case may be, depends upon the pressure of the CNG within the storage vessel to which conduits 104*a* and 104*b* are connected, and the operational configuration of the system. As described above, essentially, there are two pathways for the gas exiting outlets 164*a* and 164*b* to take depending upon the operational configuration: a low-pressure configuration in which the set point of the first pressure-reducing valve is relatively low so that the storage vessel can be drawn down as low as practical, or a high-pressure configuration in which a single storage vessel is delivering relatively high-pressure CNG to system 100.

Under the low-pressure configuration, the gas exiting coil outlet 164*a* is directed into conduit 124 and through pressure-reduction valve 130*a*, and the gas exiting coil outlet 164*b* is directed through pressure-reduction valve 130*b*. The streams delivered from valves 130*a* and 130 are combined in conduit 132. Under the high-pressure configuration, CNG is being delivered toward a single pressure-reduction valve 126 that is connected with outlets 164*a* and 164*b* by conduits 122*a* and 122*b*, respectively. While FIG. 6 illustrates two valves 126*a* and 126*b*, it is recognized that in the present embodiment depicted in FIGS. 7-9 rarely, if ever, will CNG be flowed through both conduits 104*a* and 104*b* while the respective storage tanks are under relatively high pressures. Thus, to save on capital cost, only a single pressure-reduction valve 126 is provided for this operational configuration. Generally, CNG will be flowed through conduits 104*a* and 104*b* simultaneously only when the pressure within one of the CNG storage vessels drops below a predetermined threshold value and a higher-pressure source is needed to supplement the delivery of gas from the lower pressure source.

The letdown gas from either valves 126, 130*a*, or 130*b*, as the case may be, is then directed through conduit 134, which is configured as a rounded rectangular cylindrical coil, similar to conduits 120*a* and 120*b*, although other coil shapes and configurations may be employed. The flow enters conduit 134 through a coil inlet 166 and exits through a coil outlet 168. In contrast to conduits 120*a* and 120*b*, the flow through conduit 134 is substantially a top-to-bottom configuration, meaning that the inlet 166 is disposed at a higher elevation within system 100 than outlet 168. The contents of conduit 134 are heated by a pair of laterally disposed heating elements 138.

The gas exiting through outlet 168 is directed through a pressure-reduction valve 140 where the pressure of the gas is again letdown. The reduced-pressure gas is then directed through conduit 142, which is also configured as a rounded rectangular cylindrical coil, similar to the preceding coils. The gas enters the coil through a coil inlet 170 and exits through a coil outlet 172. Similar to conduits 120*a* and 120*b*, the flow through conduit 142 proceeds in a bottom-to-top configuration, meaning that the inlet is disposed at a lower elevation within system 100 than outlet 172. The contents of conduit 142 are heated by a pair of laterally disposed heating elements 144. Should any of the previous reductions in pressure resulted in the condensation of any components of the CNG that were not re-vaporized by heating elements 138, the bottom-to-top flow path of conduit 142 permits such condensed liquids to accumulate under force of gravity in the lower portions of the coil. Thus, the condensed liquids may be held within conduit 142 until sufficient heat has been supplied by elements 138 to re-vaporize them and only gaseous products exit via outlet 172. It is noted that heating elements 118, 138, and 144 are controlled by thermostatic gas valves 145 connected to each heating element, which modulate the flow of fuel to the heating element to control the temperature of the stream being heated thereby as sensed by temperature sensors located downstream of the heating elements.

The gas is then passed through a final pressure-reduction valve 146 and the gas is then delivered to a product manifold 148 that may be coupled to any desired apparatus for further use of the letdown gas product. As discussed previously, a portion of the letdown gas product may be used as a fuel source for the various heating elements. Gas may be flowed through conduit 152, which is operably connected with manifold 148, for this purpose.

Figure 10:
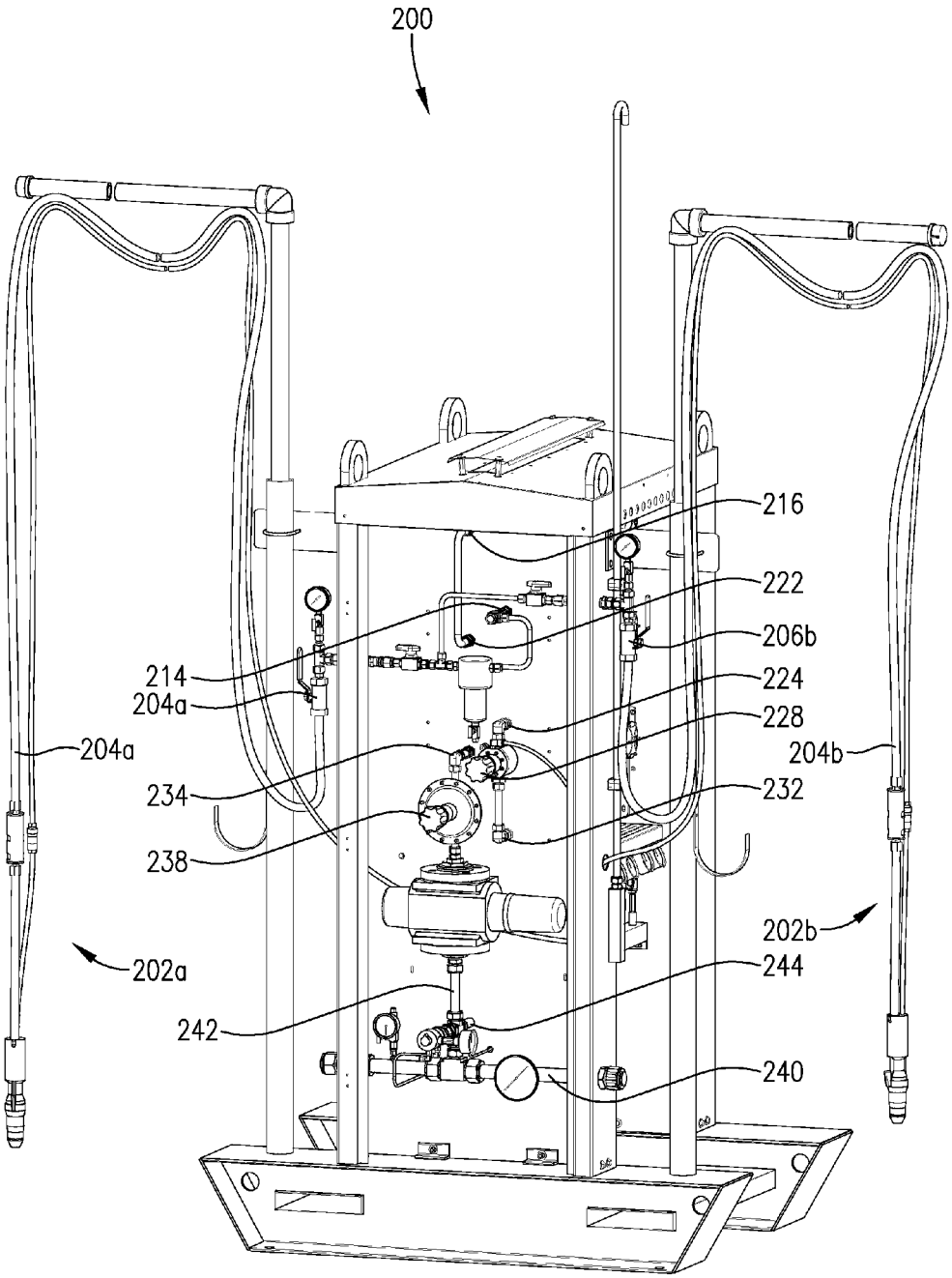
FIG. 10 depicts yet another CNG unloading system according to the present invention.
Figure 11:
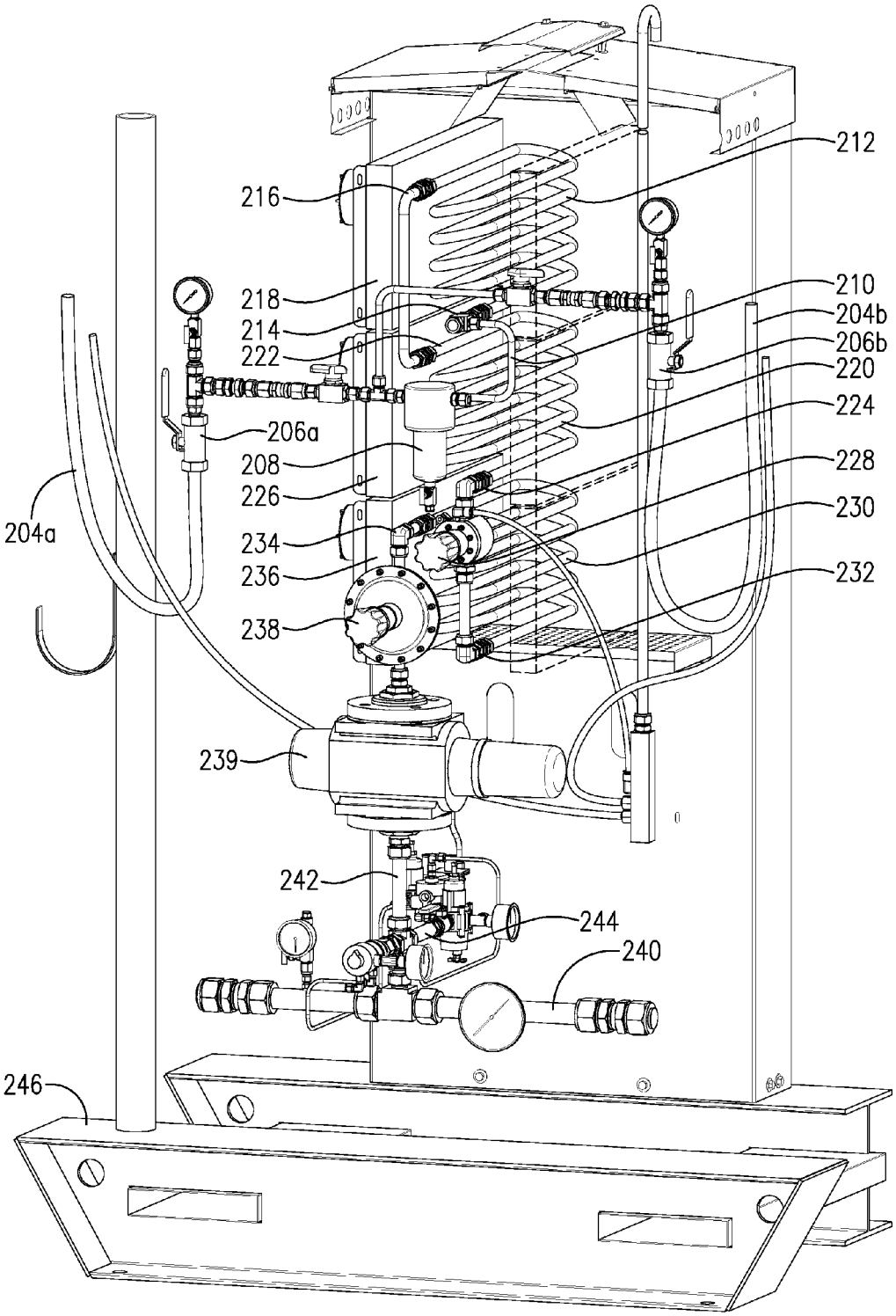
FIG. 11 is a partial cross-sectional view of the CNG unloading system of FIG. 10.
Figure 12:
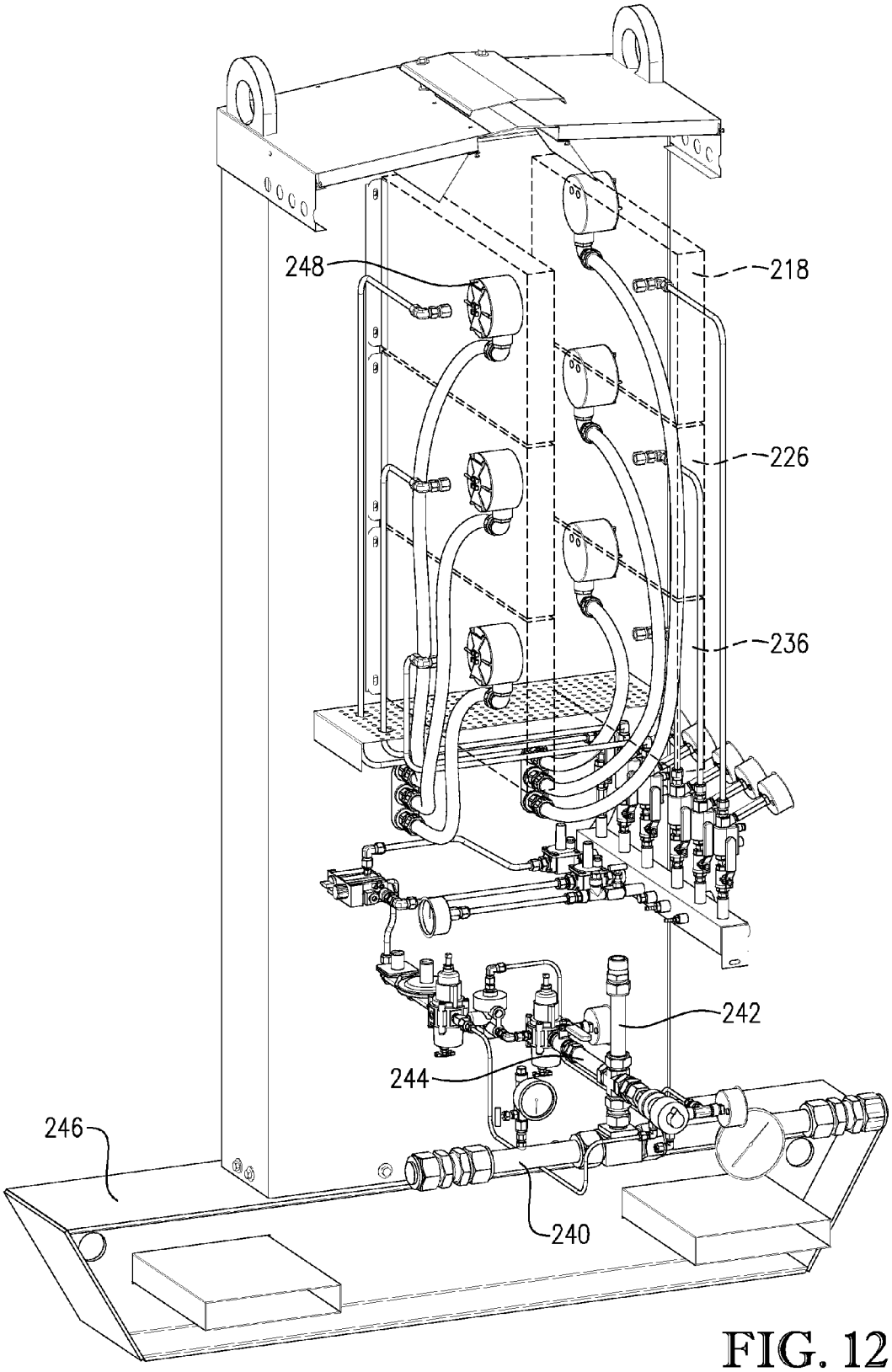
FIG. 12 is a further view illustrating certain internal components of the CNG unloading system of FIG. 10.

FIGS. 10-12 illustrate another embodiment according to the present invention. A CNG offloading system 200 is provided that is similar in many respects to the CNG offloading system 100 described above. However system 200 is simpler in design and operation in that is it configured to process only one incoming CNG gas stream at a time and is not equipped to supplement a low-pressure flow from a drawn down CNG storage vessel with a high-pressure flow from another CNG storage vessel as is system 100. System 200 comprises a pair of offloading stations 202*a* and 202*b*, each of which comprises a CNG-rated conduit 204*a* and 204*b*, and shut off valves 206*a* and 206*b*, respectively.

As noted previously, in operation CNG is normally offloaded via one of conduits 204*a* or 204*b* at any particular time. Thus, the offloaded CNG from either of conduits 204*a* or 204*b* is directed through a filter 208 and into conduit 210. Conduit 210 delivers the CNG to a first warming conduit 212 comprising a coil inlet 214 and a coil outlet 216. Conduit 212 is configured as a rounded rectangular cylindrical coil, although other configurations may be employed. Coil inlet 214 is disposed at a lower elevation within system 200 than coil outlet 216, thus the CNG flows through conduit 212 in a bottom-to-top manner. The CNG flowing through conduit 212 is warmed by heat emitted from a pair of laterally-disposed heating elements 218, similar to those described previously.

The warmed CNG exiting outlet 216 is immediately directed to a second warming conduit 220 that is also configured as a rounded rectangular cylindrical coil, although other configurations may be employed. Conduit 220 comprises a coil inlet 222 and a coil outlet 224. Coil inlet 222 is disposed at a higher elevation within system 200 than coil outlet 224, thus the CNG flows through conduit 220 in a top-to-bottom manner. The CNG flowing through conduit 220 is warmed by a heat emitted from a pair of laterally-disposed heating elements 226.

The warmed CNG exiting outlet 224 is then passed through a pressure-reduction valve 228, similar to those previously described. Following the letdown in pressure, the reduced-pressure stream is then directed through a warming conduit 230 that is configured similarly to conduits 212 and 220. Conduit 230 comprises a coil inlet 232 and a coil outlet 234. Coil inlet 232 is disposed at a lower elevation within system 200 than coil outlet 234, thus the stream flows through conduit 230 in a bottom-to-top manner. This manner of flow plays an important role in ensuring that the stream exiting outlet 234 is entirely gaseous and does not comprise any condensed liquids. The reduction in pressure caused by valve 228 results in a cooling of the stream due to the Joule-Thompson effect and may cause certain components of the stream to condense. By feeding this reduced-pressure stream into an inlet 232 to conduit 230 that is lower in elevation than the outlet 234, any condensate will tend to collect in the lower portions of the coil. Thus, these condensates will have a longer residence time within conduit 230 and the opportunity to be re-vaporized by the heat emitted from the pair of laterally-disposed heating elements 236.

The warmed stream existing outlet 234 is then passed through a pressure-reduction valve 238, where the pressure of the gas stream is reduced to its final, desired pressure. It is noted that the energy delivered to the stream flowing through conduit 230 is sufficient to warm the stream so that upon the further letdown in pressure by valve 238 the stream remains in gaseous form and condensation of any stream components is avoided. The reduced-pressure gas stream passes through a flow meter 239 and is delivered to a product manifold 240 via conduit 242. A portion of the reduced-pressure gas may be diverted into conduit 244 to be used as fuel for heating elements 218, 226, and 236.

As with system 100, the apparatus making up system 200 may be installed on a skid 246 to facilitate installation of system 200 at nearly any desired location. Heating elements 218, 226, and 236 further comprise thermostatic gas valves 248 that regulate operation of the heating elements via downstream temperature sensors.

Figure 13:
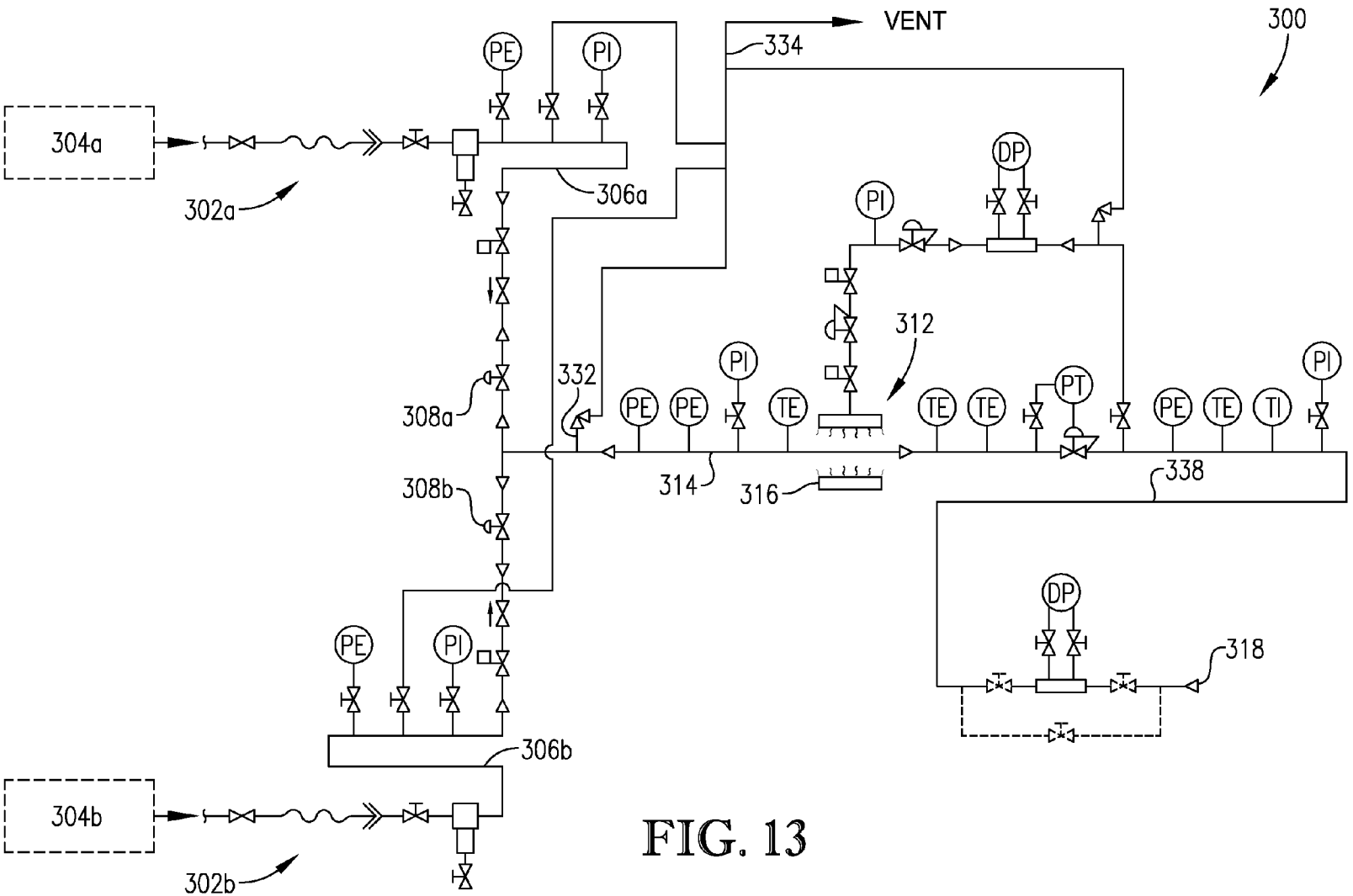
FIG. 13 is a piping and instrumentation diagram of a CNG unloading system according to another embodiment of the present invention.

FIG. 13 illustrates a further embodiment of the present invention, namely a CNG offloading system 300 that first decreases the pressure of the CNG followed by heating of the letdown gas. System 300 comprises offloading stations 302*a* and 302*b* that are configured to be connected to CNG storage vessels 304*a* and 304*b*, respectively. CNG from storage vessel 304*a* is directed into conduit 306*a* where it is passed through a letdown valve 308*a* having a desired set point. During passage of the CNG through valve 308*a*, the pressure of the CNG is reduced to a desired delivery level, and the reduced-pressure gas is directed into conduit 310*a*. During initial operation, when the pressure inside vessel 304*a* exceeds a predetermined threshold value, only CNG from vessel 304*a* is introduced into offloading system 300. During this time, CNG storage vessel 304*b* may be connected to offloading station 302*b*, however, no CNG is offloaded therefrom.

The offloaded gas in conduit 310*a* is then directed toward heating apparatus 312 via conduit 314. Heating apparatus 312 comprises one or more catalytic heating elements 316 configured to deliver infrared heat onto conduit 314. The output of heating elements 316 is adjustable depending upon the degree of cooling encountered as a result of the Joule-Thompson effect realized by passage of the CNG through valve 308*a*. The greater the pressure differential across valve 308*a*, the greater the Joule-Thompson cooling, and the greater the heat output that will be required of heating elements 316 to ensure re-vaporization of any condensed natural gas components. After passage through heating apparatus 312, the warmed natural gas is ready to be delivered via system outlet 318.

As the pressure within storage vessel 304*a* falls below a predetermined threshold value, vessel 304*a* may no longer be able to supply sufficient quantities of CNG to satisfy the demand for reduced-pressure natural gas delivered through outlet 318. In order to compensate, CNG offloading from storage vessel 304*b* may be initiated. Initially, the flow of CNG from storage vessel 304*b* is only to compensate for the decrease flow rate from vessel 304*a*. Because the Joule-Thompson cooling across valve 308*b* will be greater due to a greater pressure differential between storage vessel 304*b* and the set point of valve 308*b*, keeping the flow of let down gas into conduit 310*b* at a minimum prevents heating elements 316 from being overwhelmed and failing to deliver adequate heat to the contents of conduit 314 so as to ensure delivery of a substantially vapor product through outlet 318. As the pressure within storage vessel 304*a* continues to fall, the flow of CNG from storage vessel 304*b* can be steadily increased to maintain continuous delivery of letdown natural gas through outlet 318.

In order for storage vessel 304*a* to be drawn down to as low a level as possible, the set point of valve 308*a* is adjusted to be slightly higher than the set point of valve 308*b*. Thus, the delivery of CNG from vessel 304*a* is favored over vessel 304*b*. As noted previously, this difference in pressure may only be a few psi, but it is sufficient to permit the pressure within vessel 304*a* to be drawn down to as low a level as possible, while still ensuring sufficient delivery of reduced-pressure natural gas through outlet 318.

Once the pressure in storage vessel 304*a* has been reduced to the lowest practical level, the flow of gas from storage vessel 304*a* is discontinued and the only flow of CNG into system 300 is from storage vessel 304*b*. Because the draw from storage vessel 304*b* has been gradually increased to compensate for the gradual decrease in flow from vessel 304*a*, the output of catalytic heating elements 316 has had adequate time to adjust so as to ensure that any condensed liquids generated by Joule-Thompson cooling across valve 308*b* can be re-vaporized prior to exiting heating apparatus 312. While system 300 draws CNG only from vessel 304*b*, a full vessel may be coupled with offloading station 302*a*, and readied to provide supplemental CNG as the pressure in vessel 304*b* reaches a level that is insufficient to meet the required demand for delivery of reduced-pressure natural gas through outlet 318.

This process of supplementing the flow of gas from one storage vessel with high-pressure CNG from another storage vessel can be alternated between offloading stations so that a continuous stream of reduced-pressure natural gas can be delivered through outlet 318.

Figure 14:
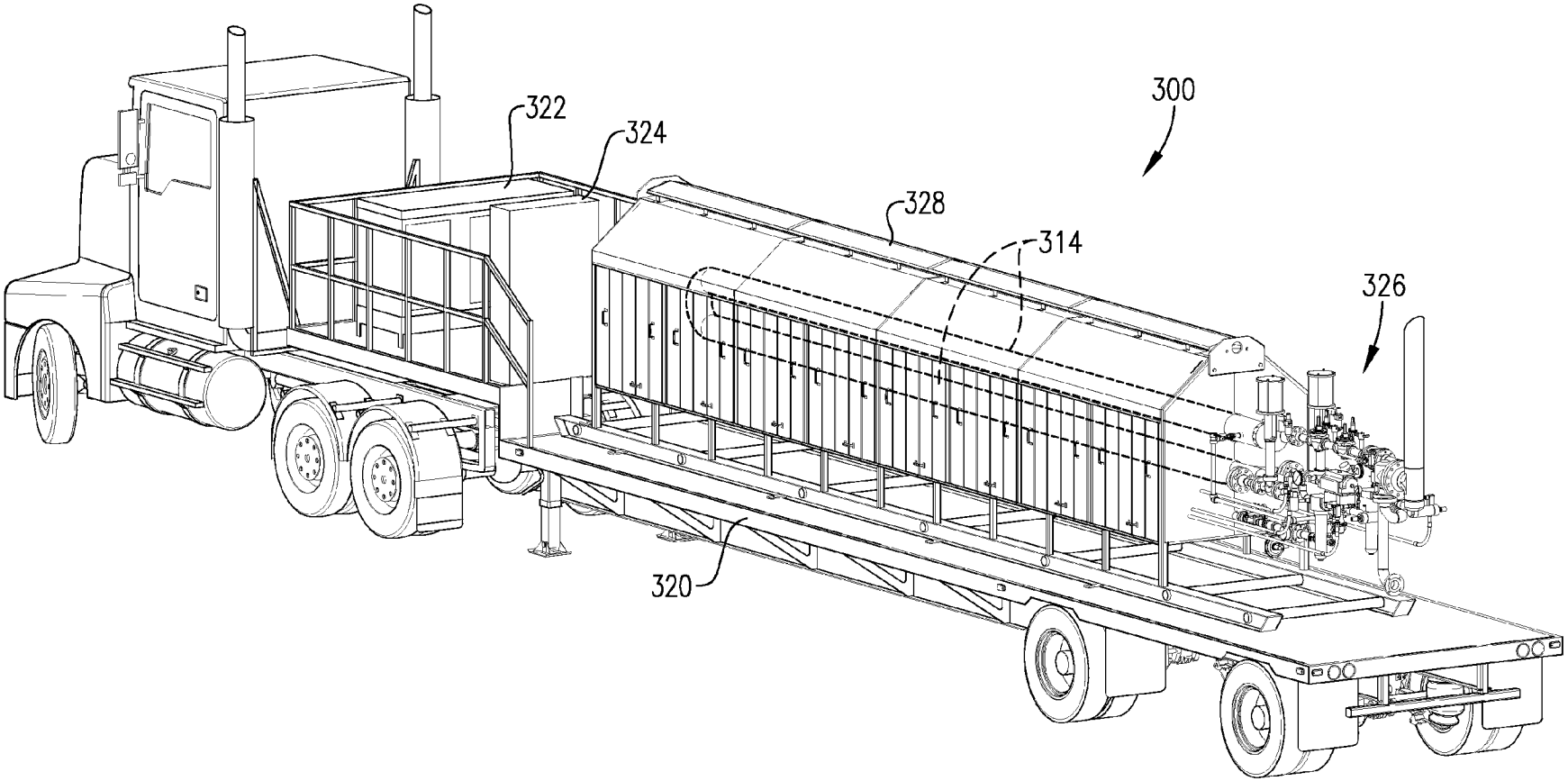
FIG. 14 depicts a self-contained CNG unloading system installed on a mobile platform.
Figure 15:
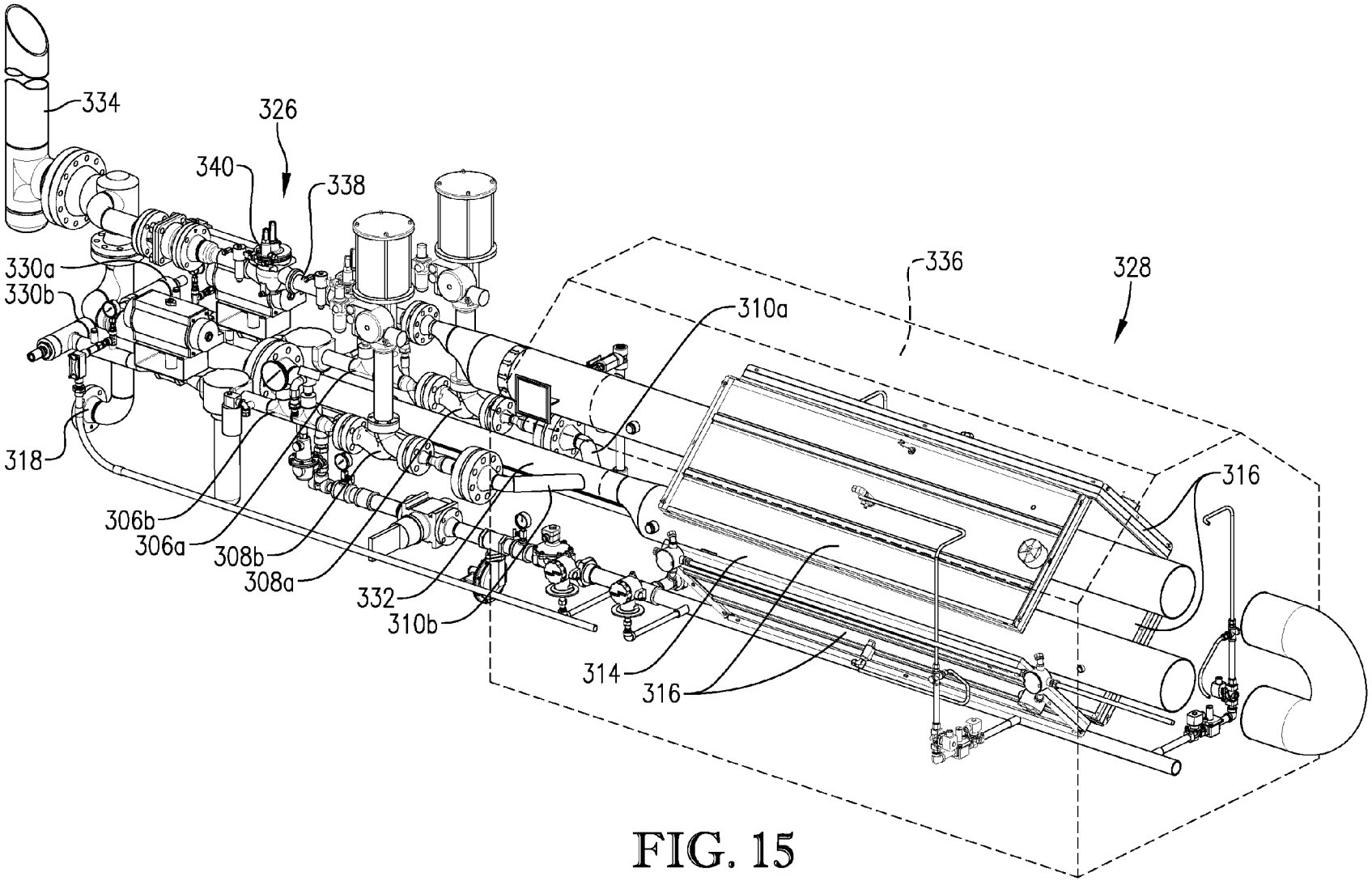
FIG. 15 is a partial cross-sectional view of the letdown apparatus illustrated in FIG. 14.

FIGS. 14 and 15 illustrate an embodiment of the present invention constructed according to the process schematic illustrated in FIG. 13. Turning first to FIG. 14, offloading system 300 is shown installed on a mobile platform 320, which in this case is a trailer. In this embodiment, system 300 also includes an on-board generator 322 capable of operation on natural gas that is letdown by the system or other fuel sources, such as diesel fuel. A control panel 324 is also mounted to trailer 320, which oversees the operation of system 300. System 300 further comprises a let down assembly 326 and a heater assembly 328, which are described in further detail below.

Turning to FIG. 15, let down assembly 326 and heater assembly 328 are shown in greater detail. A pair of CNG-receiving inlets 330*a* and 330*b* are provided and are configured for connection to CNG vessels 304*a* and 304*b* (see FIG. 13), respectively. The CNG from the storage vessels is off-loaded as described above to ensure continuous delivery of reduced-pressure gas via outlet 318. CNG received through inlets 330*a*, 330*b* are carried by respective conduits 306*a*, 306*b* and conducted through respective let down valves 308*a*, 308*b*. The reduced pressure gas (which may comprise condensed components) are conducted through respective conduits 310*a*, 310*b* into a common heating coil conduit 314. Conduit 314 comprises an overpressure relief portion 332 that may be placed in fluid communication with a vent 334 upon the pressure within portion 332 exceeding a predetermined threshold value. Conduit 314 is at least partially enclosed within housing and is generally U-shaped in configuration, making two passed between an array of heating elements 316. As discussed previously, in certain embodiments it is preferable for the reduced-pressure gas to be flowed through conduit 314 in a bottom-to-top configuration. That is, the reduced-pressure gas, which may contain condensed components, is fed into conduit 314 at a lower elevation than its point of exit. In this manner, any condensed components may be retained within the lower portion of conduit 314 for a longer period of time and be exposed to greater amount of heat energy emitted by heating elements 316 and re-vaporized prior to exiting heating assembly 328. The warmed, reduced-pressure gas is then directed into a delivery conduit 338 which may include one or more pressure regulators 340 that ensure the gas exiting through outlet 318 is of the desired pressure.

Embodiments such as those illustrated in FIGS. 13-15 may require a number of further considerations due to its letdown-then-heat configuration. For example, such systems may require a process flow control valve capable of handling cryogenic temperatures due to the large Joule-Thompson cooling effects. Other components may also need to be constructed of stainless steel that can withstand these very low temperatures. However, of greatest concern is the condensation of at least a portion of the letdown CNG. In these embodiments, it may be highly desirable to construct the warming conduit so that condensed fluids are provided adequate residence time within the heating apparatus so as to re-vaporize prior to exiting the apparatus. Units configured to process large volumes of CNG may employ a U-shaped warming conduit with the conduit inlet being at a lower elevation within the apparatus than the conduit outlet. The U-shaped conduit comprises two longitudinal sections coupled by a bight section. The longitudinal sections are substantially horizontally oriented, one above the other. This configuration permits condensed fluids to accumulate within the lower portions of the conduit, which can be drained therefrom, if necessary. Although, it is preferable for the condensed fluids to be re-vaporized by the transfer of sufficient energy from the infrared heating elements.

Certain embodiments of the present invention may provide one or more of the following advantages for the operator.

A) The heating assemblies, particularly those employing catalytic gas-fired heating elements, may be safely operated in hazardous locations.

B) Radiant heat emitted via the catalytic heating elements does not heat the air and can be transferred to the heated media without much surface temperature differential associated with the equipment.

C) The equipment does not require any venting sources to create hazardous areas, while maintaining proper over pressure protection from a typical starting pressure of 3600 psig.

D) Certain embodiments permit deep drawdowns in CNG storage tank pressures without downstream supply interruptions. Full flow rates can be maintained while automatically transferring from one storage vessel to the next with an unmanned or unsupervised transfer.

E) The heat output of the heating elements may be increased or decreased based upon the sensing of temperatures downstream of the pressure cut, while having no control over the inlet pressure or flow rate.

F) Automated HMI interfaces can be provided to assist the system operator to manually set regulators correctly to accomplish the objectives of the system.

G) The heat exchange arrangement, namely the configuration of the warming conduit and heating element placement, can be varied to assist with trapping condensed liquids until they can be re-vaporized. This is particularly important with high BTU gas (natural gas comprising higher levels of $C_2$+ hydrocarbons) associated with recovery of stranded gas, but can become a factor in other systems where lower pressure gas is allowed to get to very cold temperatures.

H) When trapped liquids are captured, they are held toward the inlet of the heat exchanger to re-vaporize. As they change state, they will not cool the gases, which have progressed further down the heat exchanger. Control over the re-vaporization of the liquids assists with good downstream pressure and temperature control.

I) The systems can avoid the use of slam shut valves, which would interrupt the flow of the gas stream.

J) Solenoid valves may be used in different ways to reduce the output of the heating elements as the temperature falls. An orifice may be drilled in some valves to reduce the amount of fuel that can flow to the catalytic heaters. On some, the main fuel solenoid may be briefly closed to interrupt the fuel flow. The internal temperature of the heater may be sensed with an embedded safety thermocouple and the gas valve can be reopened to allow the heater to pick up or start outputting more heat, if required.

K) Solid-state temperature controllers for the heating elements can be used that are turned on prior to their being a need for heat. In this manner, heat needs can be anticipated and heaters that have been turned off as a storage vessel nears empty can be preheated. All or several heating elements may be kept preheated, if the flow were highly variable, so as to achieve faster responses and wider turndown than is possible with continuously operating heaters. Catalytic heaters have to be hot to be able to operate. The required minimum temperature is about 325° F., but the heaters may be keep preheated to 450° to 500° F. for more rapid response.

L) The outlet temperature may be monitored and an easy operator-settable system can be provided to more rapidly shut the heater down, if there are rapid changes in the flow. The processes are typically slow moving, but sometimes this changes and to compensate a time-based review of the controlling process temperature input is used. If it moves further than the programmed amount, the response is greater. Typically, a single zone could be started or stopped, but two additional layers of response are also possible thereby allowing more rapid reaction, without the use of typical PID type controls.

M) Resistance temperature detectors (RTDs) may be used to monitor and compare temperature two different ways to determine if there are no or low flow conditions present. One sensor, a tube temperature limit sensor, can be located adjacent to the last heater off and first one on. As the flow slows down, the temperature will begin to rise. If it stops, the media will no longer be carrying the heat away and the temperature will trip the limit. The sensor can detect much smaller flow variations that are related to the amount of flow. This essentially creates a low-cost flow switch while not having to penetrate or place an internal object inside a pressure vessel.

N) A second sensor can be used to monitor discharge and downstream temperatures. There is a pressure cut ahead of the second sensor, but the temperature drop associated with the Joules-Thompson effect is predictable. If the flow slows or stops these readings diverge, and will allow the process to "run away" if the only process input is downstream of the pressure cut. The preferred control point is downstream of the cut, as it takes out the pressure and temperature variations upstream of the regulator. This leads to more stable control, but can be a problem if the heated gas is not flowing through the process. This feature pulls the control back to the discharge gas temperature sensor on the discharge of the heater if a preset temperature differential is exceeded and returns control seamlessly when the flow returns and warmer gas begins to reach the downstream sensor.

O) Cellular modems can be used to advise the CNG supplier that there is a need soon for another full storage vessel of gas, or that there is a need for some other sort of service, if there is an operational problem.

We claim:

1. An apparatus for unloading compressed natural gas (CNG) from a storage vessel comprising:

coupling structure for connecting said apparatus to the storage vessel containing the CNG and delivering CNG offloaded from the storage vessel to said apparatus;

a heating apparatus comprising at least one heater;

a first conduit section configured to conduct the offloaded natural gas stream through said heating apparatus, said coupling structure and said first conduit section configured to deliver said offloaded natural gas stream to said heating apparatus without substantially reducing the pressure of the offloaded natural gas stream, said heating apparatus positioned adjacent to at least a portion of said first conduit section and configured to deliver energy to said first conduit section for heating of said natural gas stream flowing therethrough; and a second conduit section comprising a pressure let down valve located downstream from said heating apparatus and operable to reduce the pressure of said natural gas stream.

2. The apparatus according to claim 1, wherein said apparatus comprises a third conduit section configured to conduct the reduced pressure natural gas stream through said heating apparatus.

3. The apparatus according to claim 2, wherein said third conduit section comprises a pressure let down valve operable to further reduce the pressure of the reduced pressure natural gas stream.

4. The apparatus according to claim 1, wherein said first conduit section is configured with a first conduit section inlet and first conduit section outlet, and wherein said inlet has a lower elevation within said apparatus than said outlet so as to retain condensates from said offloaded natural gas stream within said first conduit section.

5. The apparatus according to claim 1, wherein said first conduit section comprises a first conduit section inlet and first conduit section outlet, and wherein said first conduit section further comprises a coil having at least one complete turn between said inlet and said outlet.

6. The apparatus according to claim 5, wherein said coil comprises a central longitudinal axis oriented in a substantially upright, vertical configuration.

7. The apparatus according to claim 5, wherein said coil comprises a central longitudinal axis oriented in a substantially horizontal configuration.

8. The apparatus according to claim 5, wherein said apparatus comprises at least two opposed heaters located about said coil.

9. The apparatus according to claim 5, wherein said apparatus comprises a plurality of heaters disposed about said coil.

10. A method of unloading compressed natural gas (CNG) from a storage vessel comprising:

providing a natural gas unloading apparatus comprising:

coupling structure for connecting said apparatus to the storage vessel containing the CNG and delivering CNG offloaded from the storage vessel to said apparatus;

a heating apparatus comprising at least one heater;

a first conduit section configured to conduct the offloaded natural gas stream through said heating apparatus, said heating apparatus positioned adjacent to at least a portion of said first conduit section and configured to deliver energy to said first conduit section for heating of said natural gas stream flowing therethrough; and a second conduit section comprising a pressure let down valve located downstream from said heating apparatus and operable to reduce the pressure of said natural gas stream;

connecting said storage vessel to said coupling structure and causing said CNG to flow through said coupling structure and said first conduit section as an offloaded natural gas stream without performing any substantial reduction in the pressure of said offloaded natural gas stream between the passage thereof through said coupling structure and said heating apparatus;

heating said offloaded natural gas stream flowing through said first conduit section within said heating apparatus to produce a warmed offloaded natural gas stream;

reducing the pressure of said warmed offloaded natural gas stream by passing said warmed offloaded natural gas stream through said pressure let down valve of said second conduit section; and delivering from said natural gas unloading apparatus a usable natural gas product.

* * * * *